US008403523B2

(12) United States Patent
Gerlach et al.

(10) Patent No.: US 8,403,523 B2
(45) Date of Patent: Mar. 26, 2013

(54) METHODS, LUMINAIRES AND SYSTEMS FOR MATCHING A COMPOSITE LIGHT SPECTRUM TO A TARGET LIGHT SPECTRUM

(75) Inventors: Robert Gerlach, Draper, UT (US); Michael W. Wood, Austin, TX (US); David J. Kinzer, Baraboo, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 433 days.

(21) Appl. No.: 12/580,957

(22) Filed: Oct. 16, 2009

(65) Prior Publication Data

US 2010/0188022 A1 Jul. 29, 2010

Related U.S. Application Data

(63) Continuation-in-part of application No. 10/804,463, filed on Mar. 18, 2004, now abandoned.

(60) Provisional application No. 60/455,896, filed on Mar. 18, 2003.

(51) Int. Cl.
*F21V 9/00* (2006.01)

(52) U.S. Cl. ... 362/231; 362/230; 362/800; 362/249.02; 362/311.02

(58) Field of Classification Search ..... 362/800, 362/230, 231, 227, 234, 236, 240, 249.02, 362/249.03, 249.07, 311.02
See application file for complete search history.

(56) References Cited

U.S. PATENT DOCUMENTS

| | | | | |
|---|---|---|---|---|
| 5,882,107 | A * | 3/1999 | Bornhorst et al. | 362/281 |
| 6,379,022 | B1 * | 4/2002 | Amerson et al. | 362/231 |
| 6,441,558 | B1 * | 8/2002 | Muthu et al. | 315/149 |
| 6,523,976 | B1 * | 2/2003 | Turnbull et al. | 362/231 |
| 6,554,452 | B1 * | 4/2003 | Bourn et al. | 362/247 |

* cited by examiner

*Primary Examiner* — Evan Dzierzynski
*Assistant Examiner* — Danielle Allen
(74) *Attorney, Agent, or Firm* — Michael Best & Friedrich LLP

(57) ABSTRACT

Methods, luminaires and systems for matching a composite light spectrum to a target light spectrum are disclosed. Method embodiments may be optimized for simultaneously maximizing luminous output with minimal chromaticity error. Method embodiments may further be optimized for simultaneously minimizing both chromaticity and spectral error. Embodiments of the present invention may be used with composite light sources having four or more distinct dominant colors within the visible spectrum.

10 Claims, 15 Drawing Sheets

METHODS, LUMINAIRES AND SYSTEMS FOR MATCHING A COMPOSITE LIGHT SPECTRUM TO A TARGET LIGHT SPECTRUM

CROSS-REFERENCE TO RELATED APPLICATIONS

This is a continuation-in-part application claiming priority to U.S. utility patent application Ser. No. 10/804,463, pending, which in turn claims priority to U.S. provisional patent application No. 60/455,896, filed Mar. 18, 2003. The contents of patent application Ser. Nos. 10/804,463 and 60/455,896 are incorporated by reference for all purposes as if fully set forth herein.

BACKGROUND OF THE INVENTION

1. Field of the Invention

The present invention relates generally to lighting systems. More particularly, this invention relates to lighting fixtures, or luminaires, or systems containing four or more distinct primary wavelengths of light-emitting devices or groups of devices, e.g., light emitting diodes (LEDs) and systems for additively mixing colors of light to achieve various color matches between the composite light spectrum and a target light spectrum.

2. Description of Related Art

Light sources are varied and well known in the art. Light sources are commonly used to illuminate objects or rooms in the absence of natural light sources. Thus, light sources are very common inside buildings. One application for a light source is theatrical or stage lighting to artificially produce white and colored light for illumination and special effects.

Many conventional light sources produce wavelengths across a relatively broad portion of the visible spectrum of light, for example, incandescent, fluorescent and many high-intensity discharge (HID) lamps. Such light sources may be referred to as white light sources. Other light sources may cover a relatively narrow band of the visible spectrum. Examples of such narrowband light sources include LEDs and lasers, which inherently exhibit a color associated with the dominant wavelength of their spectral power distribution.

Conventional theatrical lighting fixtures typically utilize a lamp that radiates white light, which is then filtered in various ways to produce color when colored light is desired. Filtering subtracts certain wavelengths from a beam with a broad spectral power distribution. For example, the conventional "PAR" fixture includes a white light source (lamp) with a parabolic reflector directing light to a lens with gel color filters, and is typically housed in a cylindrical or can configuration. Conventional theatrical lighting fixtures may be automated with motors that are attached to lenses or to rolls of flexible gels (filters) that move in front of the lamp. Occasionally some fixtures are fitted with multiple overlapping rolls of gels or colored lenses. Using such filters in combination is known as subtractive color mixing and this technique provides a limited range of automated color control. On most fixtures, however, filters are fixed and must be changed manually to alter the color. Manual filter changing can be an expensive and time-consuming process.

It is also well known to combine the light of two different colors to obtain a third color. This is known as additive color mixing. Conventionally, the three most commonly used primary colors—red, green and blue (RGB)—are combined in different proportions to generate a beam that is similar in appearance to many colors across the visible spectrum. Conventional LED lighting fixtures and systems use various combinations of LEDs outputting the primary RGB colors to obtain a desired color of light. There are fixture manufacturers today who utilize a mix of red, green, and blue LEDs to produce color. Typical of such conventional systems are those disclosed in U.S. Pat. Nos. 6,016,038, 6,166,496 and 6,459,919 all to Lys et al. Other conventional LED lighting systems incorporate an additional color, amber, often with the intent of providing means of altering the correlated color temperature (CCT) when the mix of red, green, and blue LEDs is adjusted to produce white light. The general advantages of using LEDs as the basis for lighting fixtures are commonly known by those familiar with the technology in the illumination industry.

A common misunderstanding of human color perception holds that since we distinguish color by using three different kinds of receptor cones in our eyes (a widely understood and proven physiological fact), we therefore perceive only three primary colors of light. The thinking continues toward the mistaken belief that by using a mix of three primary colors of light in various relative intensities, we can precisely duplicate any color in the spectrum.

This conventional, though limited, understanding of human color perception is inaccurate. If it were true that the human eye can only respond to three colors of light, one would be unable to view a rainbow. Instead of a broad wash of graduated colors, one would see only three, very narrow lines of light. One might experience relatively little light radiating from many artificial light sources, such as neon tubes and low- and high-pressure vapor lamps, which produce discrete wavelengths of color that are often not red, green, or blue. The perceived light from other artificial sources would be greatly reduced, since fluorescent tubes (and many other lamps) produce a series of irregular spikes of color along the spectral range, rather than an even mix of all wavelengths.

Other common misunderstandings include the following: the combination of red, green, and blue light is equivalent to "full-spectrum" light; red, green and blue combined in the right proportions can produce true, white light at any CCT that appears and illuminates colored objects in the same way as a real full-spectrum source like midday sunlight; an increase or decrease in amber light alone is sufficient to alter the CCT of a white-light mix across a broad range of CCT values.

LED-based lighting fixtures that implement any of these misconceptions produce light that is inadequate for a broad range of effective, primary illumination. RGB fixtures produce colored light with relatively poor saturation across the spectrum, except at red, green, and blue. RGB fixtures illuminate colored objects in an unnatural way, making many colors appear hyper-real or more vivid than under midday sunlight but also making them appear less differentiated from one another, with a strong tendency to make colored objects appear either redder, greener, or bluer than normal. RGB fixtures exhibit relative luminance levels that are difficult for an average user to predict when mixing colors, because they do not correlate with the relative luminance levels of conventional lamps with filters of similar colors. White light from RGB fixtures appears weak, empty, or grayish to many observers. RGB fixtures often produce an undesirable response on human skin tones, making many flesh colors appear ruddy or slightly greenish or grayish. RGB fixtures have a limited range of CCT values that appear rich, full, and satisfying to the average observer.

The addition of amber to an RGB fixture (RGBA) for the purpose of "color correcting" or lowering the CCT of its white light often results in light that appears unnaturally pinkish. Most such four-color, RGBA, lighting systems do not contain amber LEDs that together produce a high enough level of relative luminance to significantly add to color-mixing capabilities or to alter the undesirable rendering of colored objects and skin tones.

Prior art by Cunningham, U.S. Pat. No. 6,683,423, describes a lighting apparatus having groups of distinct light-emitting devices, e.g. LEDs, that can be controlled to produce a beam of light having a spectrum that closely emulates that of any one of a number of conventional light sources, e.g. an incandescent bulb, and that has a normalized mean deviation (NMD) across the visible spectrum, relative to that of the beam of light being emulated, of less than about 30%.

There are flaws in the approach taken by Cunningham to describe the output of the claimed invention. The standard of 30% or less NMD does not correlate with the human eye response. The invention could achieve 30% NMD—or even much less—and still produce a light beam that behaves differently on illuminated objects and that appears very different to the average human observer than the one being emulated. Cunningham provides no metrics for relating the output of this invention to the response of an average human observer, which is the most critical component of measurement when describing an apparatus suitable for use as part of a lighting fixture. Without such metrics the invention is too broadly defined to be of real value.

For example, if the invention produces a spectral distribution curve that is slightly above the reference at wavelengths shorter than 550 and slightly below the reference at wavelengths longer than 550, the composite beam would have a much more dominant blue component than the one being emulated, although the NMD for the entire spectrum might be well within 30%. Not only would this make the beam itself have a different apparent color or whiteness, it would alter the way the beam illuminates colored objects, perhaps drastically.

In another example, if the majority of the spectrum of the invention is closely related to the spectrum of the reference source, the invention could completely omit a portion of the spectrum—a gap perhaps as large as 70 to 80 nm wide—and still have a normalized mean deviation that is relatively low. Again, this could produce drastic apparent differences to the average human observer, both in beam color or whiteness and in the illumination of colored objects.

In a third example, the Cunningham invention could produce a spectrum that was nearly identical to the reference in all but a very narrow range of wavelengths—perhaps a range only 5 nm wide. In that 5-nm range, the invention could produce a huge spike in spectral output, equivalent to the addition of a very bright, deeply saturated colored light, and still produce an NMD for the whole spectrum that is well under 30%. Obviously, the resulting light would look nothing like the reference, nor would it illuminate colored objects in the same way.

Accordingly, there exists a need in the art for LED arrays, lighting fixtures and systems that not only include LEDs emitting conventional RGB or RGBA colors, but that emit other colors as well. There also exists a need to define these inventions by parameters that are based on the human visual response, in order to provide a more certain guarantee that the inventions produce light that is desirable for a broad range of applications. Such LED arrays would overcome the inherent limitations of all known lighting fixtures that include multiple colors of LEDs.

BRIEF SUMMARY OF THE INVENTION

An embodiment of a method of matching a composite light spectrum to a target light spectrum is disclosed. The method may include providing a light emitting diode (LED) array, the LED array comprising emitters having four or more distinct dominant wavelengths within visible spectrum for generating an output composite light spectrum. The method may further include minimizing a difference between CIE chromaticity coordinates of the target light spectrum and the composite light spectrum while simultaneously maximizing luminous output of the LED array.

An embodiment of a method of matching a composite light spectrum to a target light spectrum is disclosed. The method may include providing a light emitting diode (LED) array, the LED array comprising emitters having four or more distinct dominant wavelengths within visible spectrum for generating an output composite light spectrum. The method may further include simultaneously minimizing differences between CIE chromaticity coordinates and spectral differences between the target light spectrum and the composite light spectrum.

An embodiment of a light emitting diode (LED) array including four or more distinct dominant wavelengths within visible spectrum configured for generating an output composite light spectrum matched to a preselected target light spectrum is disclosed. The output composite light spectrum of the LED array further provides maximum lumen output.

Another embodiment of a light emitting diode (LED) array including four or more distinct dominant wavelengths within visible spectrum configured for generating an output composite light spectrum matched to a preselected target light spectrum is disclosed. The output composite light spectrum of the LED array further provides best spectral match between the target light spectrum and the composite light spectrum.

An embodiment of a lighting system configured for generating an output composite light spectrum matched to a preselected target light spectrum is disclosed. The system may include a luminaire having LEDs of at least four distinct primary color wavelengths. The system may further include a controller in communication with the luminaire for driving the luminaire to generate a composite light spectrum, the composite light spectrum providing maximum lumen output and also matched for chromaticity with the preselected target light spectrum.

Additional features and advantages of the invention will be apparent from the detailed description which follows, taken in conjunction with the accompanying drawings, which together illustrate, by way of example, features of embodiments of the present invention.

BRIEF DESCRIPTION OF THE SEVERAL VIEWS OF THE DRAWINGS

The following drawings illustrate exemplary embodiments for carrying out the invention. Like reference numerals refer to like parts in different views or embodiments of the present invention in the drawings.

DETAILED DESCRIPTION OF THE INVENTION

Figure 1:
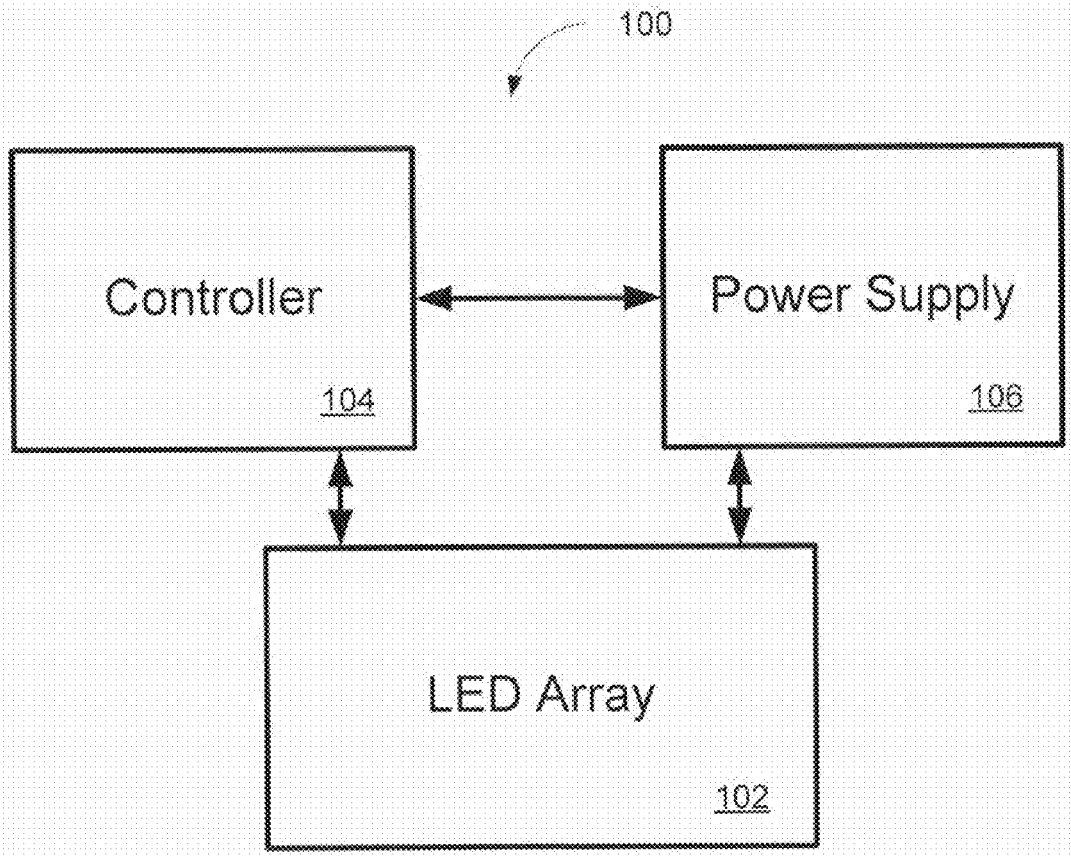
FIG. 1 is a block diagram of a LED lighting system, according to an embodiment of the present invention.

Methods, luminaires and systems for matching a composite light spectrum to a target light spectrum are disclosed. Method embodiments may be optimized for simultaneously maximizing luminous output with minimal chromaticity error. Method embodiments may further be optimized for simultaneously minimizing both chromaticity and spectral error. Embodiments of the present invention may be used with composite light sources having four or more distinct dominant colors within the visible spectrum. Embodiments of the present invention may include LED arrays, fixtures and systems utilizing LEDs radiating light in four or more different dominant wavelengths within the visible spectrum. Another embodiment of the present invention includes a method for determining human color perception. The LED arrays, fixtures and systems of the present invention may be used in any application requiring lighting ranging from mere illumination to vivid and accurate production of multiple varieties of colored and white light. One such application is in the field of theatrical lighting. Of course, one skilled in the art will recognize that the potential applications for the LED arrays, fixtures and systems of the present invention are almost limitless. LEDs suitable for embodiments of the present invention may be of any type consistent with the requirements and limitations described herein, e.g., silicon-based LED, organic LED (OLED) and polymer LED (PLED) technologies.

The distinction between the understanding that there are three kinds of color receptors (cones) in the eye and the inaccurate notion that there are only three colors of perceived light is a critical one. The human visual system is a very complex network of receptors, transmitters, and signal processors that work in conjunction with one another. Many aspects of the physical and mental processes involved in color and white-light perception remain substantially unknown to science. Current consensus within the scientific community states that color perception is a complex interaction of both positive and negative stimuli within the visual network.

It is conventionally known that there are three different kinds of receptor cones in the human eye for stimulation by specific ranges of wavelengths of light. Every wavelength of light has the potential of stimulating each of these cones at a certain level of probability. The three cone types peak in the probability that they will be stimulated at points on the visible spectrum that are roughly equal to blue-violet, green, and yellow, and are identified as short, medium, and long (S, M, and L), respectively. All three are necessary for robust color sensation across the visible spectrum. For example, a 420 nm wavelength of light has a very high probability of stimulating the S-cones in the eye, but only a low probability of stimulating the M-cones, and a very low probability of stimulating the L-cones. A human observer can distinguish it as violet light, because the S-cones in the eye are the most stimulated by it and are therefore sending the strongest signals to the brain.

A 650 nm wavelength of light has a higher probability of stimulating the L-cones than stimulating the M-cones, and a much higher probability of stimulating the L-cones than stimulating the S-cones. It is of no consequence that there are no cones in the eye that peak in their sensitivity at that particular wavelength of light. What matters is that one type of cone is more sensitive to it than the other two. This is enough for the visual network to identify the light as red. This is the same for all colors of light, i.e., that the sensitivities of the three cone types peak at certain wavelengths is not nearly as important as the fact that all three peak in different places along the visible spectrum and that the sensitivity slopes gradually downward on either side of the peaks, rather than dropping off sharply to zero.

The level of saturation of a colored light is determined by the three cones working simultaneously. If there were only two cone types, it would be possible to achieve the same relative levels of stimulation of each while using different combinations of wavelengths. For example, a 590 nm amber wavelength will stimulate the L-cones at a high probability. It will stimulate the M-cones at a moderate probability. This same combination of high stimulation of the L-cones and moderate stimulation of the M-cones could be achieved by using a 650 nm red wavelength and a 530 nm green wavelength at the same time. By varying the intensities of each color, the stimulation levels could theoretically be balanced to exactly imitate the levels caused by the 590 nm light. Two cones working alone would not allow for clear and consistent distinction between a pure wavelength and a combination of two or more that approximate the appearance of the first.

However, there are three cone types in the eye: S-, M-, and L-cones. Thus, the mix of red and green wavelengths that produces the same levels of stimulation from the M- and L-cones as amber light stimulates the S-cones differently. Amber light stimulates S-cones at a very low probability—almost zero. Green light, on the other hand, stimulates the S-cones with a slightly higher probability. This suggests that the red+green combination will appear less saturated than the pure amber light to an average observer.

It is the existence of these three kinds of cones in the eye, as well as the other receptors and processors within the human visual system (that may or may not be fully understood at this time) that teaches away from the concept that the so-called "primary colors" are capable of reproducing any other color within the visible spectrum at any given level of saturation. Every individual wavelength along the entire visible spectrum can be clearly identified and distinguished with relative precision from a substitute that mixes different wavelengths in combination to achieve its approximation. This is why RGB additive color mixing can only produce less saturated substitutions for most colors that are substantially different than red, green, and blue.

LEDs generally have a narrow spectral half-width, which means that they produce light in very saturated colors. To obtain white light from LEDs according to principles and embodiments of the present invention, multiple colors may be placed side by side and their light mixed together within the fixture. Colored light will be produced by turning on only certain LEDs or by reducing the relative luminance of certain LEDs. Ideally, a full spectrum of LEDs emitting dominant wavelengths of light completely across the visible spectrum can be obtained. However, as of this writing, some dominant wavelengths, such as 555 nm lime-yellow, are not available in commercially viable quantities in packages that produce relative luminance levels consistent with the brightest available LEDs. By varying the intensity of the nearest available colors, e.g., 530 nm green and 590 nm amber in the place of 555 nm lime-yellow, a substitution for these missing colors may be achieved according to embodiments of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

FIG. 1 is a block diagram of a LED lighting system 100 in accordance with the present invention. LED lighting system 100 may consist of only a LED array 102, or it may include a LED array 102 and a controller 104. LED lighting system may include a power supply 106 or alternatively be configured to connect to an external power supply 106. According to an embodiment of the present invention, controller 104 may independently drive any number of colors of LEDs. According to another embodiment, controller 104 may independently drive each LED in the LED array 102. Circuitry for implementing controller 104 and assembling a LED array 102 are within the knowledge of one skilled in the art having possession of this disclosure and, thus, will not be further elaborated on herein.

An embodiment of a LED array according to the present invention may be defined by plotting the output of each LED on a CIE Chromaticity diagram and connecting the points to create a region that encloses a percentage of the total area within the curve of spectrally pure colors and the straight line representing the purple colors, known as the alychne. There are a number of CIE Chromaticity diagrams suitable for this embodiment of a LED array. For example and not by way of limitation, the 1931 CIE Chromaticity Diagram for a 2-degree field and the 1976 CIE L'u'v' Diagram are both suitable CIE diagrams according to embodiments of the present invention. The percentage of the total area enclosed by the plot of dominant wavelengths on the CIE Chromaticity diagram may be any suitable fraction of 100%. For example, the percentage of the total area enclosed by the plot of dominant wavelengths on the CIE Chromaticity diagram may be at least 75%, 85%, or even 95% of the total area according to embodiments of the present invention.

Another embodiment of a LED array according to the present invention may include relative luminance values for all LEDs within the LED array operating at full brightness levels resulting in a composite white-type light that may be plotted on a CIE Chromaticity diagram within McAdam ellipses that are on or adjacent to the Planckian Locus (which defines the region of color temperatures produced by a black-body radiator) within a predefined correlated color temperature (CCT) range. The predefined CCT range may be between about 1500K and about 25,000K according to an embodiment of the present invention. The predefined CCT range may be between about 3000K and about 10,000K according to another embodiment of the present invention. In still another embodiment of the present invention the predefined CCT range may be between about 4500K and about 7500K. In yet another embodiment of the present invention, the predefined CCT range may be between about 5500K and about 6500K. Of course, other suitable predefined CCT ranges are also considered within the scope of the present invention. In still another embodiment of a LED array according to the present invention the relative luminance of each LED or group of LEDs in the LED array may comprise a spectral power distribution within 30% normalized mean deviation of a spectral power distribution of midday sunlight.

Yet another LED array according to the present invention may include a relative luminance of each LED or group of LEDs in the LED array that is consistent with the distribution of spectral power in midday sunlight in order to facilitate additive color mixing that produces intuitive intensity levels. It is understood that Luxeon brand LEDs by Lumileds, LLC, or any similarly bright LEDs from various manufacturers, may not be available in commercially viable quantities in all desired dominant wavelengths across the visible spectrum. Therefore, LEDs that are available in the dominant wavelengths nearest the desired dominant wavelength and in packages that produce brightness levels consistent with other LEDs in the array may be substituted. Those LEDs or groups of LEDs may consequently have higher relative luminance values, depending upon the distance from the desired dominant wavelength and (if applicable) the distance to the nearest available dominant wavelength on the opposite side of the desired dominant wavelength.

CIE diagrams, CCT, alychne, McAdam ellipses, and Planckian Locus are all concepts and terms well known to one of ordinary skill in the art, and thus will not be further elaborated on herein. A reference providing further detail on colorimetry is Daniel Malacara, "Color Vision and Colorimetry Theory and Applications", SPIE Press, 2002, the contents of which are incorporated herein by reference for all purposes.

An embodiment of a base-mix LED array according to the present invention may be formed of LEDs emitting at least four discrete dominant wavelengths and may include dominant wavelengths within the following ranges of visible light: red (630 to 670 nm), red-orange (600 to 630 nm), amber (585 to 600 nm), green (520 to 545 nm), cyan (495 to 520 nm), blue (460 to 495 nm) and royal blue (435 to 460 nm). Another embodiment of a base mix LED array may include 16 LEDS: one red LED, one red-orange LED, six amber LEDs, three green LEDs, two cyan LEDs, two blue LEDs and one royal blue LED of comparable brightness or power, arbitrarily arranged in a two-dimensional array. Of course, it will be apparent to one of ordinary skill in the art that various spatial combinations of the base mix LEDs may be formed into suitable arrays according to the present invention.

Table 1 below is an exemplary spatial representation of an embodiment of a base mix strip array in accordance with the present invention.

TABLE 1

| | | | | | | | |
|---|---|---|---|---|---|---|---|
| B | G | C | I | G | B | C | G |
| A | R | A | A | A | O | A | A |

The base mix strip array may include 16 LEDs spatially arranged as shown in Table 1, where B=blue, G=green, C=cyan, I=royal blue, A=amber, and O=red-orange LEDS. A single unit formed of the 16 LEDs as shown in Table 1 may form a 2×8 micro-strip fixture according to an embodiment of base mix LED array. Each of the seven colors may be controlled by a separate circuit or by a single LED driver circuit with independent control of each LED according to other embodiments of a base mix LED array. According to a specific embodiment of base mix strip array, the LEDs may be mounted in rows within the channels on a finned extrusion, thereby providing adequate heat-dissipating surface area while leaving a flat surface exposed for wall-mounting or other surface mounting of the fixture. One such extrusion is part #XX5052 from Wakefield Thermal Solutions, Inc., 33 Bridge Street, Pelham, N.H. 03076. Of course, other suitable extrusions, custom-designed housing components, and mounting arrangements for the LEDs in a fixture that maintain the spatial arrangement of Table 1 are also contemplated within the scope of the present invention.

Further embodiments based on arrays of the base mix LED array and variants are also contemplated in the present invention. For example, an embodiment of a LED array according to the present invention may include a linear array of base mix strip arrays. The LED arrays may be stacked horizontally or vertically according to further embodiments of the present invention. For example, an embodiment of a 2×32 LED array may include 4 base mix strips stacked horizontally.

Table 2 below illustrates a variation of the base mix strip array that may be referred to herein as a reverse base mix strip array.

TABLE 2

| | | | | | | | |
|---|---|---|---|---|---|---|---|
| A | A | O | A | A | A | R | A |
| G | C | B | G | I | C | G | B |

where R=red, O=red-orange, A=amber, G=green, C=cyan, B=blue and I=royal blue. Note that the reverse base mix array is the same as the base mix array rotated 180°.

Further embodiments based on arrays of the reverse base mix strip array and variants are also contemplated in the present invention. For example, an embodiment of a LED array according to the present invention may include a linear array of reverse base mix strip arrays. The LED arrays may be stacked horizontally or vertically according to further embodiments of the present invention. Additionally, according to another embodiment, a 4×16 LED array may consist of two base mix strip arrays stacked horizontally with two reverse base mix strip arrays also stacked horizontally and then vertically underneath the two base mix strip arrays. Such a 4×16 LED array may produce a single, composite beam that is roughly equivalent to that produced by a PAR fixture.

Table 3, below, illustrates an embodiment of a 4×4 base mix array,

TABLE 3

| | | | |
|---|---|---|---|
| B | G | A | C |
| A | R | G | A |
| A | I | O | A |
| C | A | G | B |

where R=red, O=red-orange, A=amber, G=green, C=cyan, B=blue and I=royal blue. The 4×4 base mix array comprises a nearly symmetrical design for a 4×4 special fixture. Each of the seven colors may be controlled by a separate circuit or by a single LED driver circuit with independent control of each LED according to other embodiments of a base mix LED array.

LEDs for the above-referenced LED arrays may be Luxeon™ LEDs, a 1.2-Watt package of the specified color/wavelength. Luxeon™ LEDs are available from Lumileds Lighting, LLC, 370 West Trimble Road, San Jose, Calif. 95131.

A preferred embodiment includes all LEDs in the lambertian radiation pattern package with or without secondary, collimating optics. Dominant wavelengths for suitable LEDs according to the present invention may be approximately as follows: I=royal blue=455 nm, B=blue=470 nm, C=cyan=505 nm, G=green=530 nm, A=amber=590 nm, O=red-orange=617 nm and R=red=625 nm. Of course, any suitable source of LEDs consistent with embodiments of the present invention may also be used, including those with nearly the same colors but different approximate dominant wavelengths.

The LEDs may be mounted with thermally conductive adhesive onto the flat surface(s) of an aluminum extrusion with heat-dissipating fins, according to embodiments of the present invention.

Figure 2:
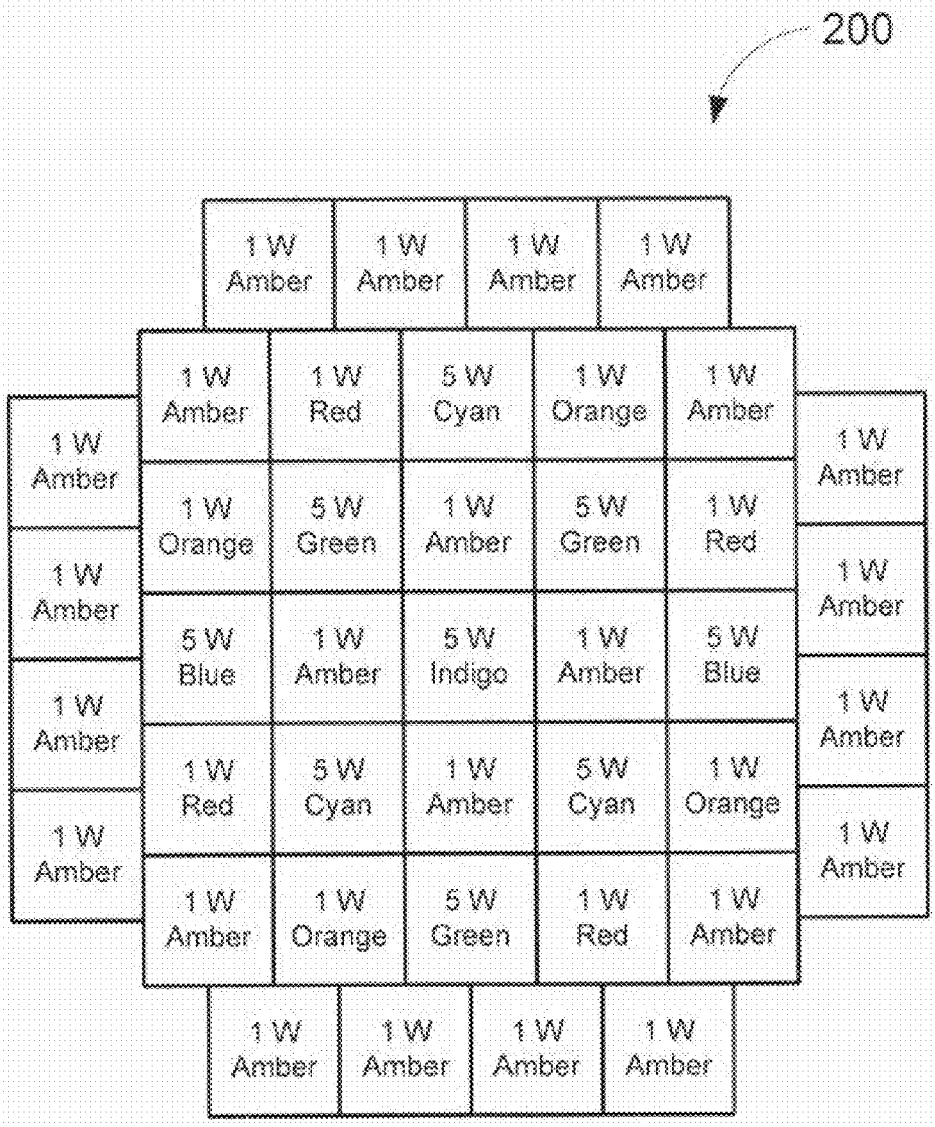
FIG. 2 illustrates a two-dimensional layout of an embodiment of a LED array, according to the present invention.

FIG. 2 illustrates another embodiment of a LED array 200 consistent with the present invention. According to an embodiment of LED array 200, the individual LEDs may be Luxeon by Lumileds, emitter package, lambertian radiation pattern, and either 1.2-Watt or 5-Watt package depending on the individual LED color as indicated in FIG. 2. LED array 200 may be configured as an ultra-high-density fixture fitting within an approximately 2.5×2.5 square inch area. LED array 200 may include secondary optics to mix and subsequently focus the light from the whole array of individual LEDs into a single, shaped beam according to an embodiment of the present invention. Another embodiment of LED array 200 may include a light-pipe design attached to additional collimating lenses. According to yet another embodiment, LED array 200 may include collimating lenses followed by a rectangular or circular Fresnel-type lens. The seven colors may be controlled with the same or similar controller circuitry as used for the above-described fixtures, i.e., the seven colors or individual LEDs may be dimmed separately according to other embodiments of the present invention.

An embodiment of a LED array may be formed of a plurality of LEDs, each LED or group of identically colored LEDs comprising a dominant wavelength within the visible spectrum (400 to 750 nm). Another embodiment of a LED array may be configured with each LED or group of identically colored LEDs within the LED array configured for independent control.

According to another embodiment of a LED array according to the present invention, each LED or group of identically colored LEDs may produce colored light with a predefined spectral half-width, for example less than about 60 nm, or less than about 40 nm, or less than about 30 nm. Of course these are only exemplary spectral half-widths and other spectral half-widths consistent with the present invention are also considered within the scope of the present invention.

Yet another embodiment of a LED array may include a plurality of LEDs comprising at least the following specified colors and within 25 nm of an associated dominant wavelength: violet 425 nm, blue 465 nm, cyan 500 nm, green 530 nm, lime 555 nm, amber 580 nm, orange 610 nm and red 650 nm. Other embodiments consistent with the present invention may include associated dominant wavelengths within 15 nm or even 5 nm of the specified colors and dominant wavelengths.

Yet another embodiment of a LED array according to the present invention may include a plurality of LEDs comprising at least the following specified colors and falling within 25 nm of an associated dominant wavelength: violet 405 nm, indigo 445 nm, blue 480 nm, cyan 510 nm, green 535 nm, lime 555 nm, yellow-amber 575 nm, orange 600 nm, orange-red 630 nm, and deep red 665 nm. Other embodiments of a LED array consistent with the present invention may further include associated dominant wavelengths within 15 nm or even within 5 nm of the specified colors and dominant wavelengths.

Still another embodiment of a LED array according to the present invention may include the plurality of LEDs comprising at least the following specified colors and within 25 nm of an associated dominant wavelength: violet 410 nm, indigo 445 nm, blue 475 nm, cyan 500 nm, aqua 520 nm, green 540 nm, lime 555 nm, yellow 570 nm, amber 590 nm, orange 610 nm, red-orange 635 nm and deep red 665 nm. Other embodiments may further include associated dominant wavelengths within 15 nm or even 5 nm of the specified colors and dominant wavelengths. Of course, the proximity of the associated dominant wavelengths may be arbitrarily selected within the range of nm to 25 nm, consistent with the present invention. The above described embodiments are merely exemplary.

Another embodiment of a LED array according to the present invention may include having each dominant wavelength separated from its nearest neighbor on either side by not more than a predefined separation distance. Any predefined distance within the range from about 10 nm to about 50 nm is consistent with embodiments of the present invention. For example and not by way of limitation, 20 nm, 30 nm, and 40 nm are embodiments of a predefined separation distance consistent with the present invention. According to yet another embodiment the separation between the dominant wavelengths may gradually increase away from either side of approximately 555 nm. Yet another embodiment of a LED array according to the present invention may further include LEDs with a dominant wavelength in the near-ultra-violet region defined from about 300 nm to about 400 nm.

Yet further embodiments of a LED array according to the present invention may include a plurality of LEDs numbering less than or equal to a predetermined number of LEDs. For example and not by way of limitation the predetermined number of LEDs may be 100, 64, 32 or 16 LEDs according to embodiments of the present invention. Embodiments of a LED array according to the present invention may further include each of the plurality of LEDs comprising a predetermined power rating. For example and not by way of limitation, the predetermined power rating may be at least 0.25, 0.5, or 1.0 Watts of power at full brightness according to embodiments of the present invention.

Figure 3:
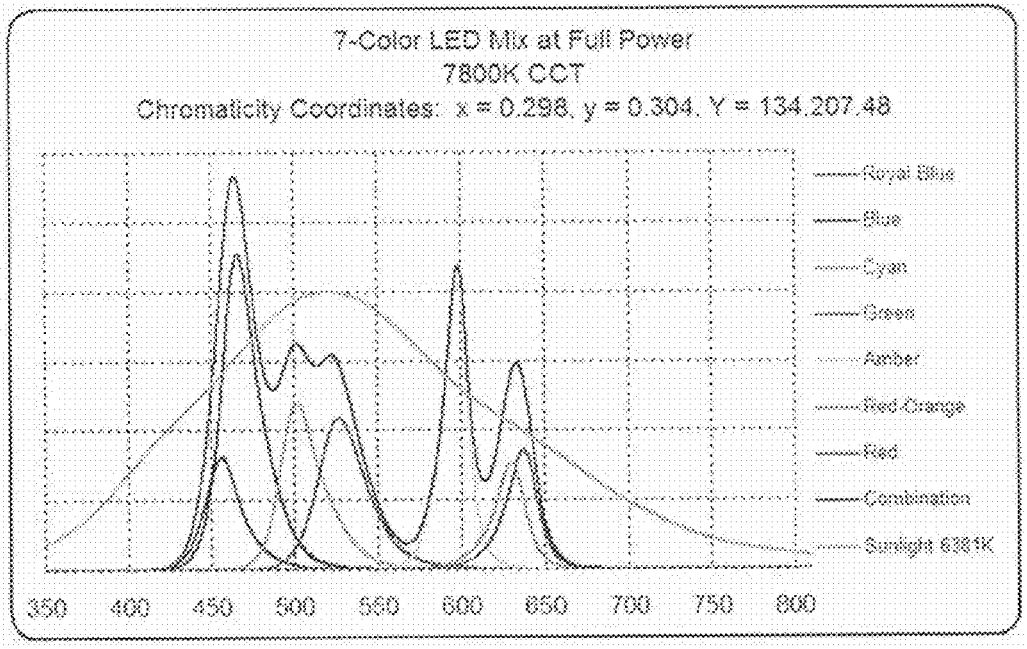
FIG. 3 is a graph of the spectrum of a 7-Color LED array at full power, according to an embodiment of the present invention.
Figure 4:
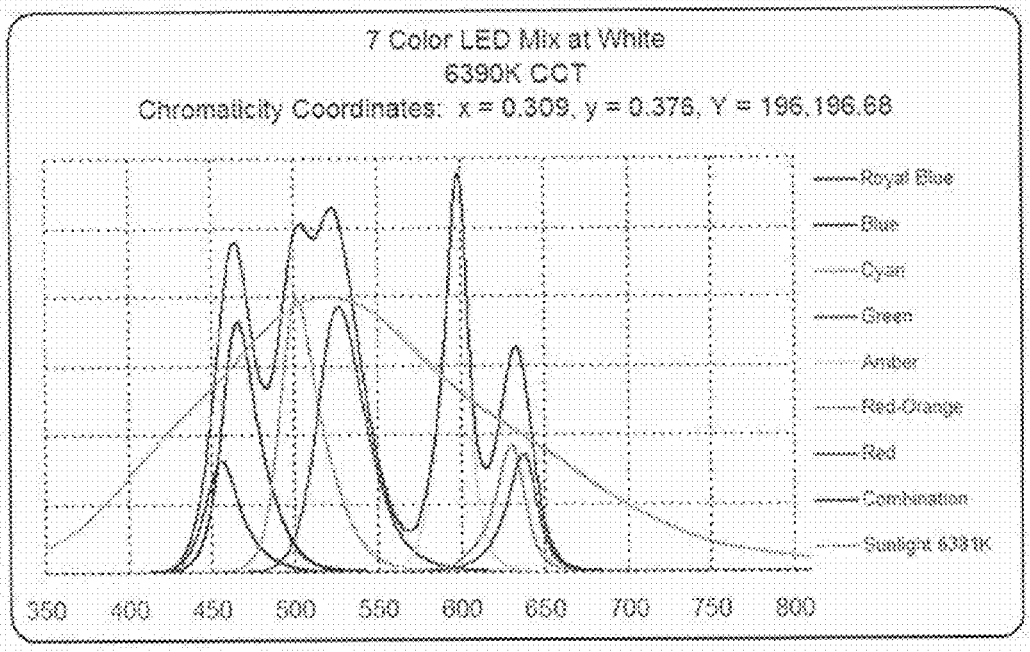
FIG. 4 is a graph of the spectrum of a 7-Color LED array at white, according to an embodiment of the present invention.
Figure 5:
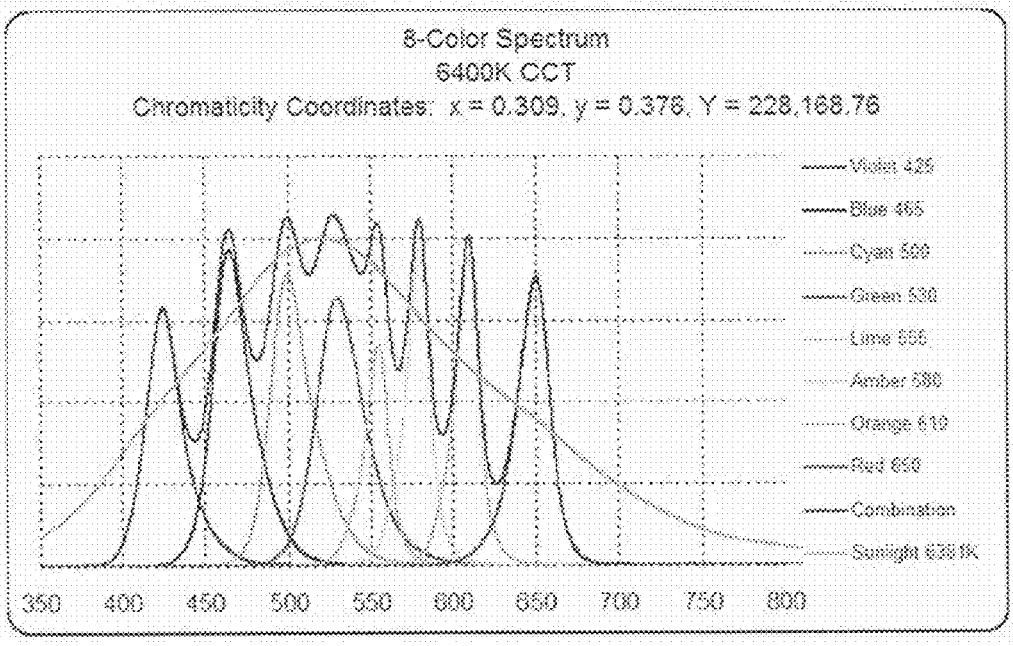
FIG. 5 is a graph of the spectrum of an 8-Color LED array, according to an embodiment of the present invention.
Figure 6:
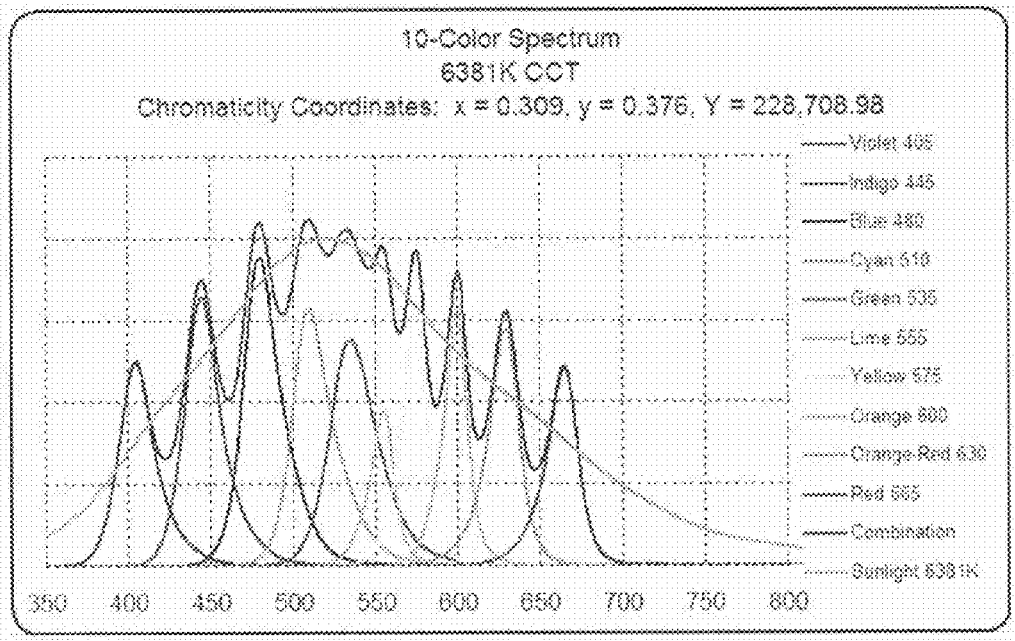
FIG. 6 is a graph of the spectrum of a 10-Color LED array, according to an embodiment of the present invention.
Figure 7:
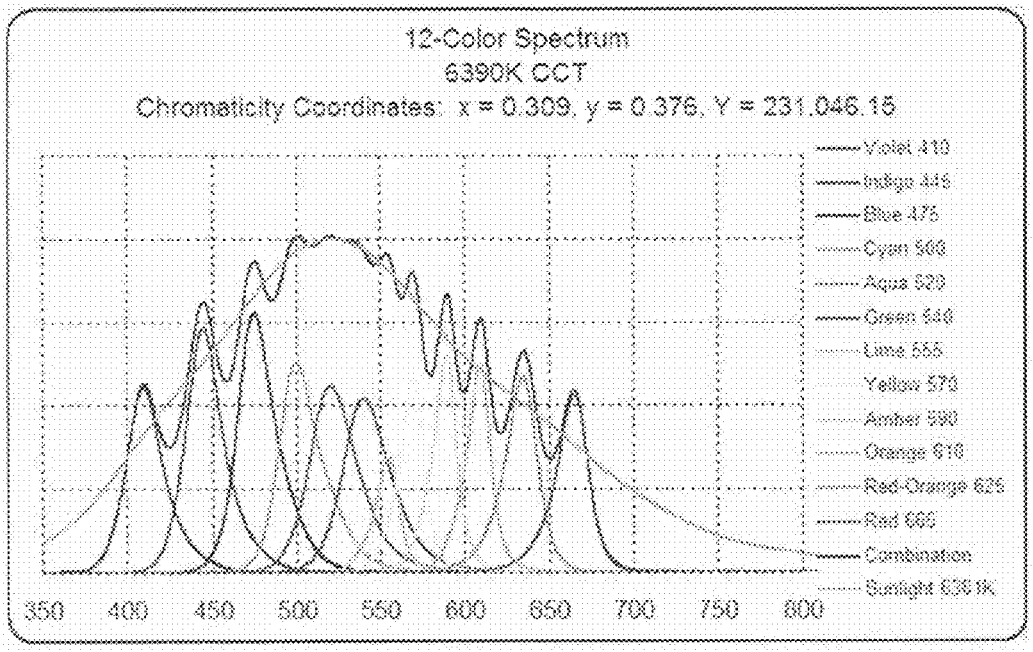
FIG. 7 is a graph of the spectrum of a 12-Color LED array, according to an embodiment of the present invention.
Figure 9:
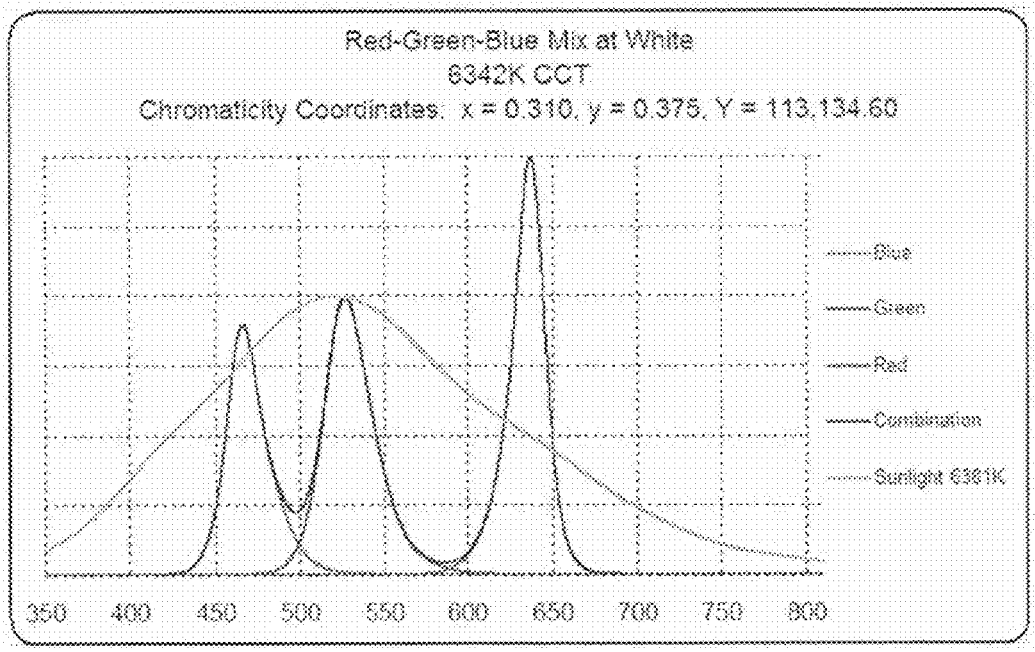
FIG. 9 (Prior Art)
FIG. 9 is a graph of the spectrum of a conventional RGB LED array.

FIG. 3 is a graph of the spectrum of a 7-Color LED array at full power in accordance with an embodiment of the present invention. FIG. 4 is a graph of the spectrum of a 7-Color LED array at white in accordance with an embodiment of the present invention. FIG. 5 is a graph of the spectrum of an 8-Color LED array in accordance with an embodiment of the present invention. FIG. 6 is a graph of the spectrum of a 10-Color LED array in accordance with an embodiment of the present invention. FIG. 7 is a graph of the spectrum of a 12-Color LED array in accordance with an embodiment of the present invention. FIG. 9 is a graph of the spectrum of a conventional RGB LED array.

Figure 10:
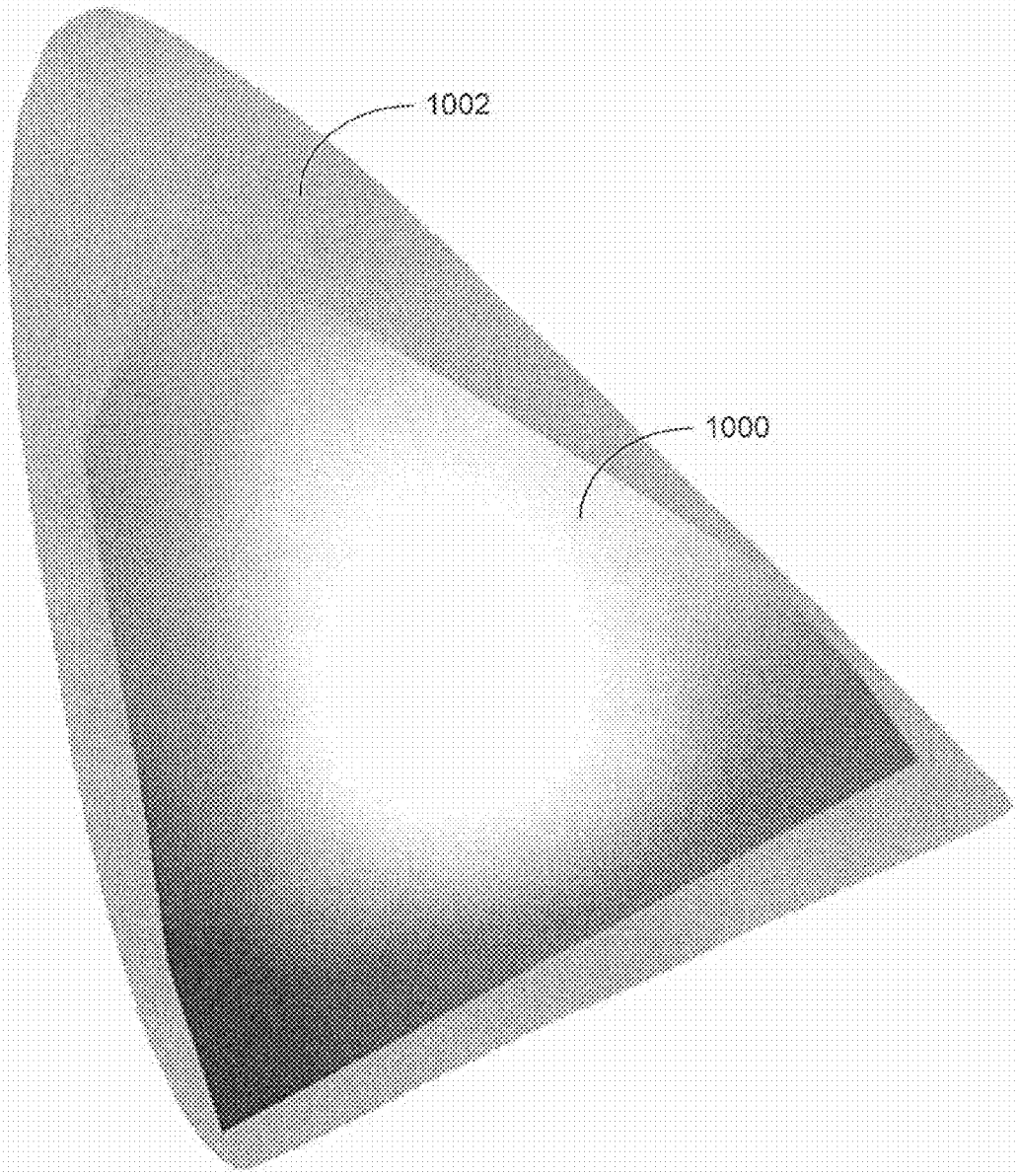
FIG. 10 is a graphical representation of an area enclosed by plotting the output of each uniquely colored LED from an LED array according to the present invention on a CIE Chromaticity diagram as a point and connecting the points. The area covers approximately 75% of the total area defined within the curve of spectrally pure colors and an alychne of purple colors on the CIE Chromaticity diagram.

FIG. 10 is a graphical representation of an exemplary area 1000 enclosed by plotting the output of each uniquely colored LED from an LED array according to the present invention on a CIE Chromaticity diagram as a point and connecting the points. The area 1000 covers approximately 75% of the total area 1002 defined within the curve of spectrally pure colors and an alychne of purple colors on the CIE Chromaticity diagram. It will be understood that this and other combinations of uniquely colored LEDs in an LED array may be used to achieve coverage of at least 55% of the total area 1002.

Figure 11:
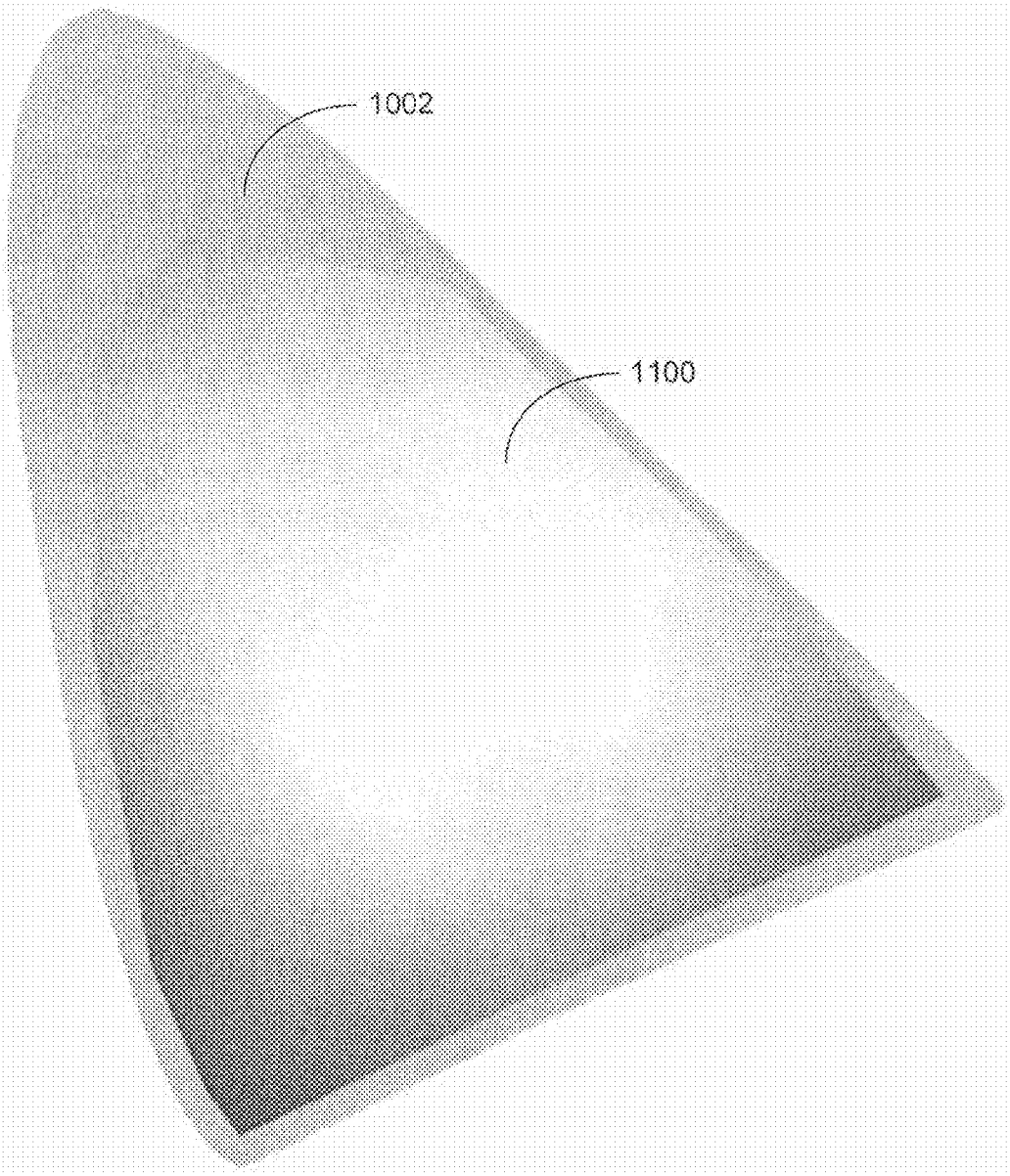
FIG. 11 is a graphical representation of an area enclosed by plotting the output of each uniquely colored LED from an LED array according to the present invention on a CIE Chromaticity diagram as a point and connecting the points. The area covers approximately 85% of the total area defined within the curve of spectrally pure colors and an alychne of purple colors on the CIE Chromaticity diagram.

FIG. 11 is a graphical representation of an exemplary area 1100 enclosed by plotting the output of each uniquely colored LED from an LED array according to the present invention on a CIE Chromaticity diagram as a point and connecting the points. The area 1100 covers approximately 85% of the total area 1002 defined within the curve of spectrally pure colors and an alychne of purple colors on the CIE Chromaticity diagram. Again, it will be understood that this and other combinations of uniquely colored LEDs in an LED array may be used to achieve coverage of at least 85% of the total area 1002.

Figure 12:
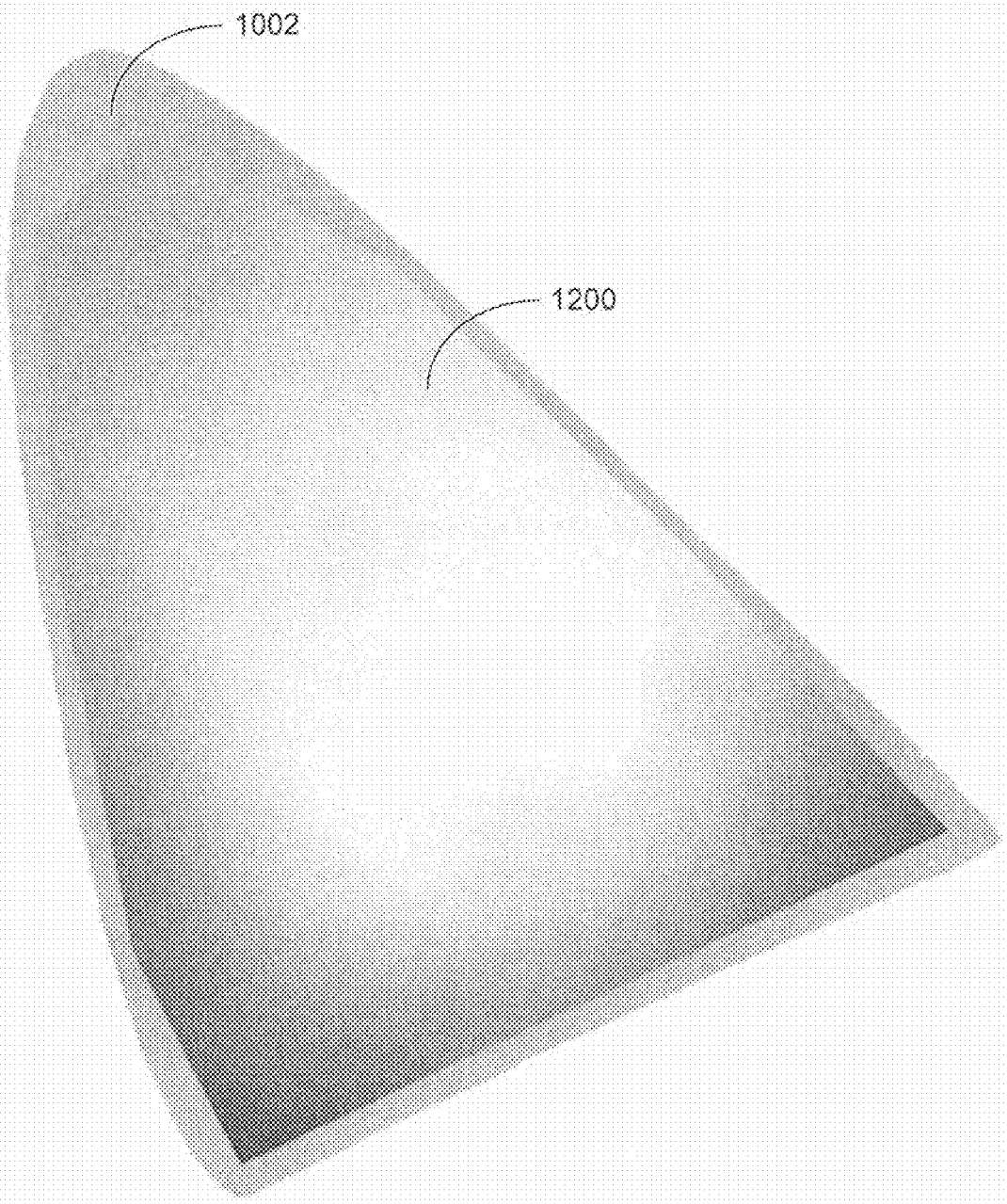
FIG. 12 is a graphical representation of an area enclosed by plotting the output of each uniquely colored LED from an LED array according to the present invention on a CIE Chromaticity diagram as a point and connecting the points. The area covers approximately 95% of the total area defined within the curve of spectrally pure colors and an alychne of purple colors on the CIE Chromaticity diagram.
Figure 13:
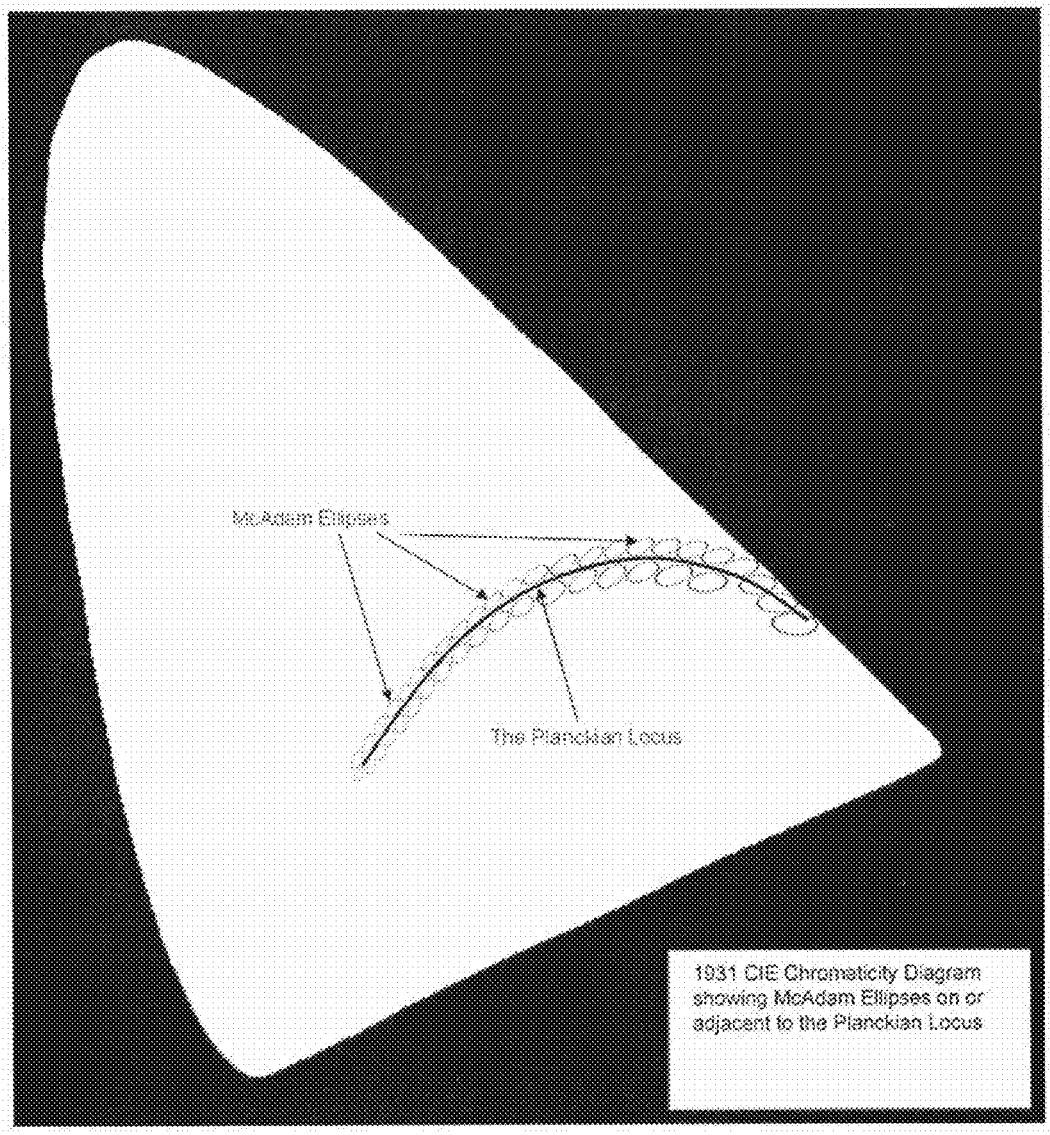
FIG. 13 is a graphical representation of a 1931 CIE Chromaticity Diagram illustrating exemplary McAdam Ellipses on or adjacent to the Planckian Locus.

FIG. 12 is a graphical representation of an area 1200 enclosed by plotting the output of each uniquely colored LED from an LED array according to the present invention on a CIE Chromaticity diagram as a point and connecting the points. The area 1200 covers approximately 95% of the total area 1002 defined within the curve of spectrally pure colors and an alychne of purple colors on the CIE Chromaticity diagram. Again, it will be understood that this and other combinations of uniquely colored LEDs in an LED array may be used to achieve coverage of at least 95% of the total area 1002.

Figure 8:
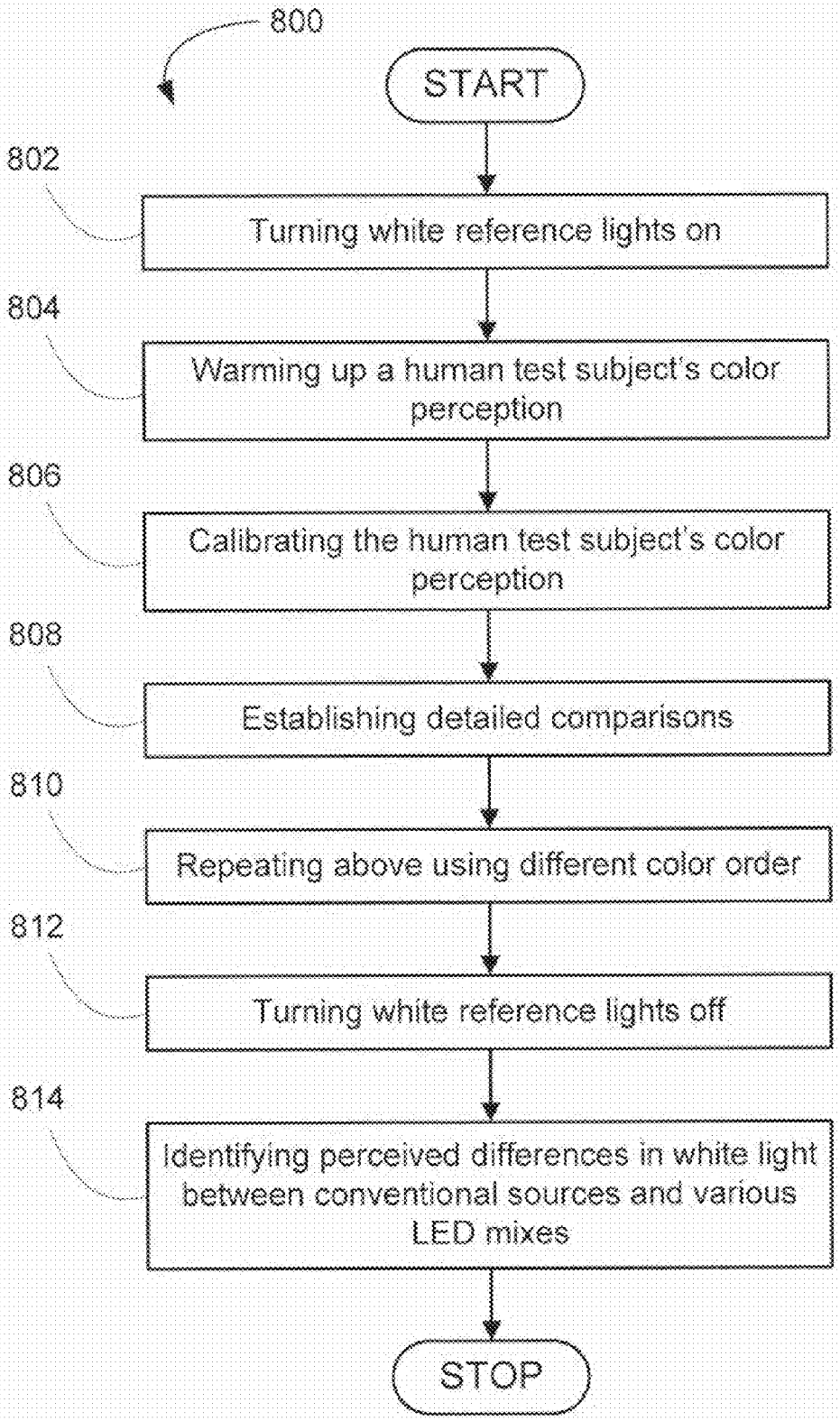
FIG. 8 is a flow chart of a method for determining human color perception, according to the present invention.

FIG. 8 is a flow chart of a method 800 for determining human color perception in accordance with the present invention. Method 800 for determining human color perception may be synonymously referred to herein as a "test". The purpose of this test is to determine a suitable design for additive color mixing within the proposed LED-based lighting fixture. Method 800 may include turning on 802 white reference lights, warming up 804 a human test subject's color perception and calibrating 806 the human test subject's color perception. Method 800 may further include establishing 808 detailed comparisons and repeating above 810 using different color order. Method 800 may further include turning off 812 white reference lights and identifying 814 perceived differences in white light between conventional sources and various LED mixes.

A test fixture may be used in conjunction with method 800 according to an embodiment of the present invention. The test fixture may include three windows set side by side on a black panel. Behind each window is an array of ten groups of LEDs at various dominant wavelengths. Each window may also include a halogen lamp that can be filtered, as well as other sources, such as fluorescent bulbs according to embodiments of the present invention. Between these big windows are two smaller windows, behind which are halogen lamps that serve as a constant white reference during color testing—allowing test subjects to keep their eyes refreshed.

The ten dominant wavelengths of LEDs in the test fixture include: red (660 nm), orange-red (625 nm), orange (605 nm), amber (590 nm), lime-yellow (565 nm), green (530 nm), cyan (510 nm), blue (475 nm), indigo (450 nm) and blue-violet (420 nm). These colors may be spaced approximately even across most of the visible spectrum. Six of the colors (orange-red, amber, green, cyan, blue, indigo) are obtained from single, 1.2 Watt LEDs (Luxeon™ LEDs by Lumileds). The other four colors are produced by LEDs in the standard 5-mm package that is often used in smaller or older LED fixtures. Consequently, for these smaller LEDs, up to fifty LEDs of a single color were required to achieve comparable brightness levels between all ten colors.

Method 800 is portable and may be administered to various kinds of individuals, including lighting professionals in their own work locations as well as the general population in public settings, e.g., malls, museums and the like. According to an embodiment of the method 800, the test subject sits at a table with a test administrator. For some portions of method 800 the white reference lights will be on. During other portions of the method 800 the white reference lights will be off (see the specific embodiment of method 800 below).

There are a number of factors that may bias the responses during the test. For example, sensitivity to perceived differences in color will likely change as the test progresses. Colors are relative—what looks lime green next to a red light might look orange next to a cyan light. Colors in isolation may appear more or less saturated than when they are viewed next to other colors. Ambient lighting in the testing location may affect color perception. The way a color is remembered may be different than what was actually viewed. Physiological and demographic factors may influence the precision with which a subject perceives color. Minimizing such biasing factors may increase the accuracy of the test results.

The following is an exemplary test scenario in accordance with embodiments of method 800. The exemplary test scenario was applied to approximately seventy human test subjects ranging in age from fifteen to sixty-five years old. The human test subjects included lighting professionals as well as average consumers. The human test subjects were asked to provide quantitative ratings of color mixes in three different test sections comprising Tests I-III.

The following definitions apply to the exemplary test scenario as described herein. "RGB" refers to a mix of red, green, and blue LEDs only—comparable to LED fixtures already on the market. "High-Brightness" refers to a mix of Luxeon™ brand LEDs, i.e., those used in the test fixture described above and limited in colors to orange-red, amber, green, cyan, blue, and indigo. "All Ten Colors" refers to the combination of red, orange-red, orange, amber, lime-yellow, green, cyan, blue, indigo and blue-violet. "Single Color" refers to one of red, orange-red, orange, amber, lime-yellow, green, cyan, blue, indigo and blue-violet.

In Test I human test subjects viewed one test color at a time, comprised of either a single color of LED or a combination of multiple LEDs, i.e., colors made from RGB, the High-Brightness mix, and All Ten Colors. The human test subjects were asked to indicate the perceived saturation of the color according to the following scale: 0=very pale, 1=quite pale, 2=slightly pale, 3=moderately saturated, 4=quite saturated and 5=as deeply saturated as is possible.

The results of Test I of the exemplary test scenario are contained in Table 4-Saturation Level, below. Table 4 includes a column showing the name of the test color, the light source used to produce the color, and the average saturation rating received for each color and source. The test colors of red, green, and blue were omitted, since for all possible combinations—RGB, High-Brightness, and All Ten Colors—the same LED colors would have been used. The light source with the highest average score (saturation) is shown for each color in bold.

TABLE 4

| SATURATION LEVEL | | |
|---|---|---|
| COLOR NAME | LIGHT SOURCE | AVERAGE SCORE |
| Red-Orange | **Single Color** | **3.8** |
| Red-Orange | RGB | 3.2 |
| Orange | **Single Color** | **3.8** |
| Orange | High-Brightness | 3.3 |
| Amber | **Single Color** | **2.9** |
| Amber | RGB | 2.4 |
| Yellow | **High-Brightness** | **2.8** |
| Yellow | All Colors | 2.1 |
| Yellow | RGB | 1.6 |
| Lime | **Single Color** | **2.8** |
| Lime | **RGB** | **2.8** |
| Lime | High-Brightness | 2.6 |
| Cyan | **Single Color** | **3.7** |
| Cyan | RGB | 2.6 |
| Indigo (bright) | **Single Color** | **4.6** |
| Indigo (bright) | RGB | 2.8 |
| Indigo (dim) | **Single Color** | **4.0** |
| Indigo (dim) | RGB | 3.3 |
| Violet | **High-Brightness** | **3.7** |
| Violet | RGB | 2.7 |
| Magenta | **High-Brightness** | **4.3** |
| Magenta | RGB | 3.0 |
| Purple | **High-Brightness** | **3.6** |
| Purple | RGB | 2.4 |

In Test II human test subjects viewed two similar test colors comprised of different combinations of LEDs, e.g., the amber LED alone compared with a mix of red and green LEDs that approximated the appearance of the amber as closely as possible. The human test subjects were asked to first identify the more saturated color of the two, then rate the difference between the two saturation levels according to the following scale: 0=too different to be related, 1=related but very different, 2=obvious difference, 3=perceptible difference, 4=barely perceptible difference and 5=no difference.

Table 5 shows the results of Test II, with the name of the test color in the left column, followed by the two color combinations used to achieve the test color and their respective numbers of votes for being the more saturated combination. The votes did not always total the same number as some of the human test subjects were unable to perceive a difference in saturation for particular colors. The right column shows the average difference perceived between the two versions of each test color. The light sources having the highest perceived saturation are shown in bold in Table 5.

TABLE 5

| COLOR | Which light source is more saturated? | VOTES | | | AVERAGE DIFFERENCE |
|---|---|---|---|---|---|
| **Red-Orange** | **Single** | **34** | 22 | RGB | **2.6** |
| **Orange** | High-Brightness | 9 | **47** | Single | **3.1** |
| **Orange** | RGB | 15 | **40** | Single | **1.4** |
| **Amber** | RGB | 22 | **34** | Single | **1.3** |
| **Yellow** | All Colors | 10 | **47** | Lime + Amber | **3.1** |
| **Yellow** | Lime + Amber | 16 | **40** | RGB | **1.6** |
| **Yellow** | High-Brightness | 8 | **45** | Lime + Amber | **3.8** |
| **Lime** | **Single** | **51** | 4 | High-Brightness | **3.6** |
| **Lime** | **RGB** | **40** | 15 | Single | **3.1** |
| **Cyan** | **Single** | **49** | 5 | RGB | **2.8** |
| **Indigo** | Single(bright) | 14 | **41** | **Single(dim)** | **3.2** |
| **Indigo** | **Single** | **52** | 1 | RGB | **2.8** |
| **Violet** | Single | 2 | **54** | **High-Brightness** | **3.4** |
| **Violet** | **Single** | **42** | 12 | RGB | **2.3** |
| **Purple** | **High-Brightness** | **47** | 8 | RGB | **1.7** |
| **Purple** | RGB | 6 | **48** | **High-Brightness** | **1.0** |
| **Purple** | **High-Brightness** | **49** | 7 | RGB | **0.7** |
| **Magenta** | **High-Brightness** | **50** | 5 | RGB | **1.1** |
| **Magenta** | RGB | 5 | 52 | **High-Brightness** | **1.6** |
| **Magenta** | **High-Brightness** | **51** | 3 | RGB | **2.5** |

The test results in Table 5 suggest that for most test colors the RGB mix appeared less saturated than the High-Brightness mix, All Colors mix and single LEDs, especially at yellow, amber, indigo and magenta. The six-LED, High-Brightness mix consistently appeared more saturated than RGB, as did the All Colors mix of all ten LED colors. The only exception was for a lime-yellow color, where RGB was rated slightly more saturated than the High-Brightness mix. Some mixes of multiple LEDs, at colors such as red-orange, appeared more saturated than single LEDs of the same apparent color, perhaps because they seemed more natural-looking, perhaps because it is rare in nature to see a color like red-orange that does not also include some deep red, orange, and amber components.

In Test III the human test subjects viewed a mix of LEDs that approximated white as closely as possible at one of three correlated color temperatures. They viewed mixes of white light at roughly 7,400 K (cool white), 5,600 K (medium white), and 3,800 K (warm white) and comprised of either RGB, a High-Brightness mix (six colors), or an All Colors mix of all ten LED colors. The human test subjects were asked to rate the perceived whiteness of the mix according to the following scale: 0=too colored or gray to be called white, 1=white, but obviously colored or gray, 2=white, but slightly colored or gray, 3=as white as normal indoor lighting, 4=as white as midday sunlight and 5=whiter than midday sunlight.

The test results in Table 6 for Test III shows the correlated color temperature in the left column, the color combination used to produce white light at that temperature in the center column, and the average perceived whiteness of each test mix in the right column.

TABLE 6

| CORRELATED COLOR TEMPERATURE | LIGHT SOURCE | Whiteness AVERAGE |
|---|---|---|
| Warm White (3,800 K) | All Colors | 1.5 |
| | RGB | 0.8 |
| | **High-Brightness** | **2.2** |
| Medium White (5,600 K) | **High-Brightness** | **3.8** |
| | RGB | 0.9 |
| | All Colors | 2.3 |
| Cool White (7,400 K) | RGB | 0.7 |
| | All Colors | 2.0 |
| | **High-Brightness** | **4.4** |

The results for the whiteness test shown in Table 6 suggest that the High-Brightness LED mix appeared whiter than both the RGB mix and the All Colors mix of all ten colors at all correlated color temperatures. The highest-rated white was the high-brightness mix at 7400K.

There were many factors that might have influenced the performance of the test and partially skewed the results. The intensity and quality of ambient light in the test environment, the speed at which the test was conducted, the distance from the test device at which the observers sat, the ambient temperature (which can vary slightly alter the color produced by LEDs) and the order in which the different tests were administered, among many other factors, might have affected the perceived quality of light produced by each color mix. Additionally, it is acknowledged that the exemplary test results above are not a completely clinical examination of human color perception. However, these limited results suggest that the current approaches to additive color mixing in LED fixtures, namely RGB and RGBA, are not producing light of the highest possible quality and that lighting professionals and others would benefit from fixtures incorporating a more inclusive or comprehensive mix of LED colors.

The exemplary test results suggest four conclusions: (1) the composition of LED colors used in an array can have a profound impact on apparent color mixing capabilities, (2) average observers perceive major differences between white light made of many discrete colors and that made of only a few, (3) the best color production appears to be from arrays made with the most possible colors of LEDs, and (4) the best white light appears to be that which contains the most wavelengths across the spectrum.

One embodiment of a color mix for a LED array consistent with the present invention may include seven colors of LEDs in ultra-high-brightness packages—comprising the six high-brightness colors used for testing and an additional high-brightness red LED. However, as the availability of additional high brightness LEDs covering additional portions of the visible spectrum increases, alternative embodiments will become apparent. The particular embodiment of a LED array of the present invention includes any suitable number of high-brightness, color LEDs sufficiently covering the visible spectrum to allow the user to accurately reproduce any desired dominant wavelength at any desired level of saturation and at a relative luminance level that is consistent with the distribution of spectral power in midday sunlight. The LED arrays, lighting fixtures and systems of the present invention offer advantages over conventional lighting systems for reproducing visible light for a number of reasons. For example, the LED lighting fixtures can produce more deeply saturated colors across the entire visible spectrum, generate richer whites with a greater range of realistic correlated color temperatures, generate fuller soft colors that are more appealing and more natural-looking, especially on skin tones, illuminate colored objects in a manner more similar to midday sunlight or other conventional white-light sources, and provide well-balanced color mixing with intuitive intensity levels at all colors.

Figure 14:
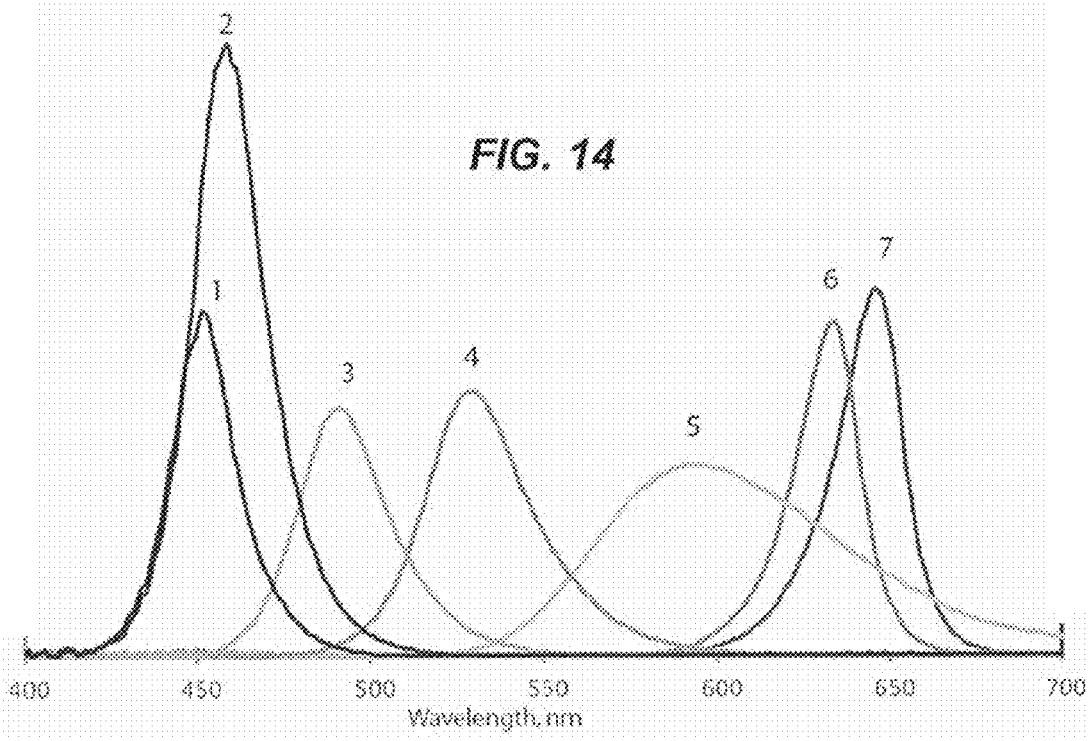
FIG. 14 is a graph of the individual spectra of a 7-Color LED array, according to an embodiment of the present invention.

A further problem to be solved involves the calculation of the correct proportions of each of the individual component LED wavelengths in an array to achieve the desired output color. If a simple system comprising just three LED colors, red, green, and blue is used then the problem has a single solution. As will be recalled from previous discussion any color that falls within the triangle formed by the three colors plotted on the CIE chart may be produced by providing the correct proportion of each of the three colors. The solution for three source colors is unique as only one proportional mix of the three colors will provide a mixed output that matches the chromaticity coordinates of the target color. However, when the number of LED wavelengths in the array increases above three, color points may have more than one potential solution. FIG. 14 illustrates seven color wavelengths that may be included in a seven color LED array according to the present invention. It will be understood that a wide range of solutions is possible using these seven wavelengths. For example, if it were desired to match a pale amber color then this might be achieved either by mixing suitable proportions of LEDs 2, 4, and 6 or by mixing suitable proportions of LEDs 1, 3 and 7 amongst many other triad (three color) solutions. In addition all combinations of the triad solutions may also produce the same chromaticity coordinates. Each of these various solutions has the same xy chromaticity coordinates, but with differing spectral compositions. Colors like this that agree in chromaticity but differ in spectral composition are commonly called metamers.

Figure 15:
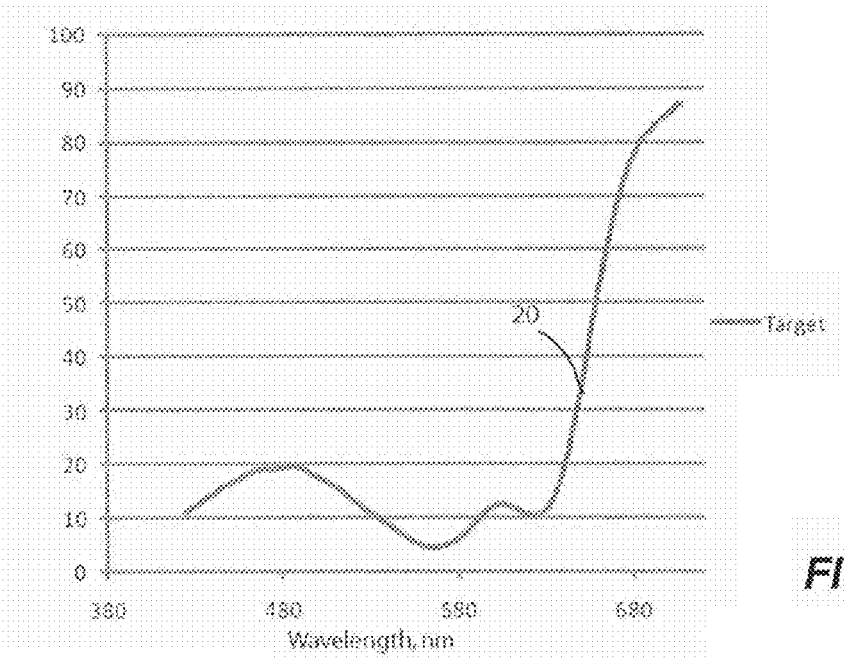
FIG. 15 is a graph of a target spectrum.

With a seven color array as illustrated in FIG. 14, there are potentially hundreds of different mixes of the LEDs possible to match a single desired target color. These mixes are all metamers and will all match in chromaticity, but differ in spectral composition. FIG. 15 is a graph of the spectrum of a target color 20 which may be a theatrical gel or other color reference. To narrow down the choices from the plurality of possible metameric matches for this color we need to define further criteria for matching in addition to the chromaticity. In one embodiment of the invention it is desired to establish the mix of the LEDs in a multi-colored array so as to match the target color with the highest lumen output possible. In a further embodiment of the invention it is desired to establish the mix of the LEDs in a multi-colored array so as to match the target color with the highest color rendering index possible. In a yet further embodiment of the invention it is desired to establish the mix of the LEDs in a multi-colored array so as to match the target color with the closest spectral match possible. All of these example mixes are metamers of each other and thus will all match in chromaticity but differ in spectral composition.

Expressing the problem more generally and mathematically, we wish to find the best values for the coefficients $A_1$ through $A_m$ as follows:

$$F(\lambda)=A_1C_1(\lambda)+\ldots+A_mC_m(\lambda) \quad \text{Eq. (1)}$$

Where $F(\lambda)$ is the composite light spectrum, $A_1$ to $A_m$ are the mix coefficients and $C_1(\lambda)$ to $C_m(\lambda)$ are the known measured spectral radiant power distributions of LED emitters 1 through m. The term "output spectral radiant power distribution" is used synonymously with the term "output spectrum", herein.

To maximize lumen output each of the components of the above function, $F(\lambda)$, may further be multiplied by the CIE photopic luminous efficacy function, $V(\lambda)$, and integrated so that the total lumen output, Lumens, is expressed by:

$$\text{Lumens}=\int F(\lambda)V(\lambda)d\lambda \quad \text{Eq. (2)}$$

The CIE photopic luminous efficacy function, $V(\lambda)$, (also known as a photopic curve) represents the response of the average human eye to various colors in light adjusted conditions. It indicates that the average human eye is most sensitive to light in the yellow-green region of the visible spectrum and that this sensitivity drops off as when moving towards red in one direction or blue in the other. Since human eyes are most sensitive to yellow-green light, $V(\lambda)$ peaks in the yellow-green region (approximately 555 nm). $V(\lambda)$ tapers off to zero below 400 nm (in the ultraviolet region) and above 700 nm (the infrared region). Thus, to determine how bright something looks to the human eye, one must "weight" (i.e., multiply) the spectral power distribution of the source by the photopic curve, and then integrate over the visible wavelengths.

The chromaticity components x,y of output spectrum $F(\lambda)$ may be calculated through normal CIE functions, as known to those of ordinary skill in the art:

$$F(\lambda)\rightarrow x_o,y_o \quad \text{Eq. (3)}$$

A squares difference error, $E_c$, may be calculated between the target CIE chromaticity coordinates, $x_t,y_t$, and the output composite light CIE chromaticity coordinates, $x_o,y_o$:

$$E_c=W((x_o-x_t)^2+(y_o-y_t)^2) \quad \text{Eq. (4)}$$

where W is a weighting factor applied to the chromaticity error.

Equations (1)-(4) may be easily computed for a given set of sprectra, $C_i(\lambda)$, and coefficients, $A_i$. The values for the coefficients, $A_i$, may be determined by choosing a criterion, such as maximum lumens (Eq. (2)) with minimum chromaticity error (Eq. (4)) by using conventional numerical optimizations processes that are well known in the art. Such conventional numerical goal seeking processes are known by many names and may include, but are not limited to, the following types of optimization processes: least squares, linear, quadratic, conic, smooth non-linear and non-smooth. Various embodiments of an optimization process could be executed as process steps in hardware or software, either in real-time or in advance to produce a look-up table, according to the present invention.

The look-up tables relating a color standard, e.g., a theatrical gel color, to the mix of colors needed for a specific lighting product, or scene, may typically be stored in the "fixture library" of a hardware-based lighting controller or "control desk", for example and not by way of limitation, the ETC Eon™, available from the assignee of the present application, Electronic Theater Controls, Inc., 3031 Pleasant View Rd, Middleton, Wis. 53562-0979. As an example, when an operator requests a color, say "Lee 344", from a Selador™ Lustr™ luminaire, the lighting control desk will interrogate the fixture library for this combination and output the resultant values as control signals to the luminaire.

Conventional fixture libraries may provide a maximal lumen solution through a different technique, but do not currently provide a best spectral match solution or any other optimal solutions. Embodiments of the present invention allow a controller or lighting control desk, through its fixture library, or through direct real-time calculation, offer the user a selection of differing lighting solutions or special effects rather than a single "maximal lumen" solution. It will be understood that a controller or lighting control desk may include, or be in communication with, a computer for executing calculations to perform the process optimizations disclosed herein. Such process optimizations may then be used to selectively drive the various colors of LEDs or other narrowband light sources to generate a composite light as desired. It will also be understood that embodiments of processes and methods disclosed herein may be implemented at computer instructions for execution by a processor in the form of software. It will be further understood that such a software embodiment of the disclosed method embodiments may be stored in suitable computer storage media, including but not limited to removable storage media and volatile and non-volatile computer memory storage of any kind known to those of ordinary skill in the art.

Coefficients $A_1$ to $A_m$ may be varied such that the Eq. (2) is maximized and the weighted chromaticity error, $E_c$, is minimized. A suitable weighting factor W may be chosen to ensure that the desired chromaticity accuracy is met. By experimentation, the inventors have shown that the solution provided by these equations with multiple LEDs in an array converges to a solution for maximal lumen output.

According to another embodiment where it is desired to optimally match the spectrum of the target as closely as possible, a different approach may be taken. The output spectral radiant power distribution, $F(\lambda)$, may still be expressed by Eq. (1) above. If the target spectrum that we wish to match is $P(\lambda)$ then we may express the equation for the error, $E_s$, that we want to minimize as:

$$E_s = \sum_{i=1}^{n} [(P(\lambda_i) - F(\lambda_i))^2] \times \bar{y}(\lambda_i) \quad \text{Eq. (5)}$$

In Eq. (5) we sum the square of the difference between the target, $P(\lambda)$, and output spectrum, $F(\lambda)$, at n points across the spectrum and multiply it with the CIE photopic function, $\bar{y}(\lambda_i)$. The multiplication by the CIE photopic function, $\bar{y}(\lambda_i)$ ensures that the error is weighted so as to match the response of the human eye. The number of points, n, is chosen such that calculation time may be minimized but that a desired degree of accuracy may be achieved. In practice, 100 points across the visible spectrum may be sufficient.

We must also apply the secondary constraint of matching chromaticity and the x,y chromaticity coordinates of output spectrum, $F(\lambda)$, which may be calculated through normal CIE functions, as stated in Eq. (3) above, and a squares difference error, $E_c$, calculated between the target $x_t,y_t$ chromaticity coordinates and the output $x_o,y_o$ chromaticity coordinates, as stated in Eq. (4) above. The total error $E_t$ we wish to minimize may be stated as:

$$E_t = E_s + E_c \quad \text{Eq. (6)}$$

The values for the coefficients, $A_i$, may be solved by conventional numerical goal seeking algorithms as discussed above. As noted above, such conventional numerical goal seeking algorithms may include, but are not limited to, the following types of algorithms: linear optimization, quadratic optimization, conic optimization, smooth non-linear optimization and non-smooth optimization. Many algorithms of this type rely upon being able to define a single output value which we need to maximize or minimize. For example in this case, the output value may be calculated as a total error value, $E_t$, combining weighted values of chromaticity error, $E_c$, with weighted values of spectral match error, $E_s$.

According to one method embodiment, all possible combinations of coefficients, $A_1$ to $A_m$, (i.e., the proportions of each of the input colors) may be varied such that the error, $E_t$, is minimized. This method may be used to establish which combination has the lowest error value. A suitable weighting factor W may be chosen to ensure that the desired chromaticity accuracy is met. Experimentation shows that the solution provided by these equations with multiple LEDs in an array converges to a solution for best spectral match.

A particular method embodiment may be implemented in software, according to the present invention. For example, and not by way of limitation, an Excel™ spreadsheet, running on a personal computer (PC) may be used to implement an embodiment of the method. It will be understood that according to other embodiments, the same method may be executed in advance, to create look-up tables that provide best matches to various standard theatrical gel colors or other color standards such as Pantone™ colors, or sunlight, or an incandescent lamp with or without color filters, etc. Such look-up tables for particular optimizations may be placed in a fixture library of a lighting control desk, according to another embodiment of the present invention.

Figure 16:
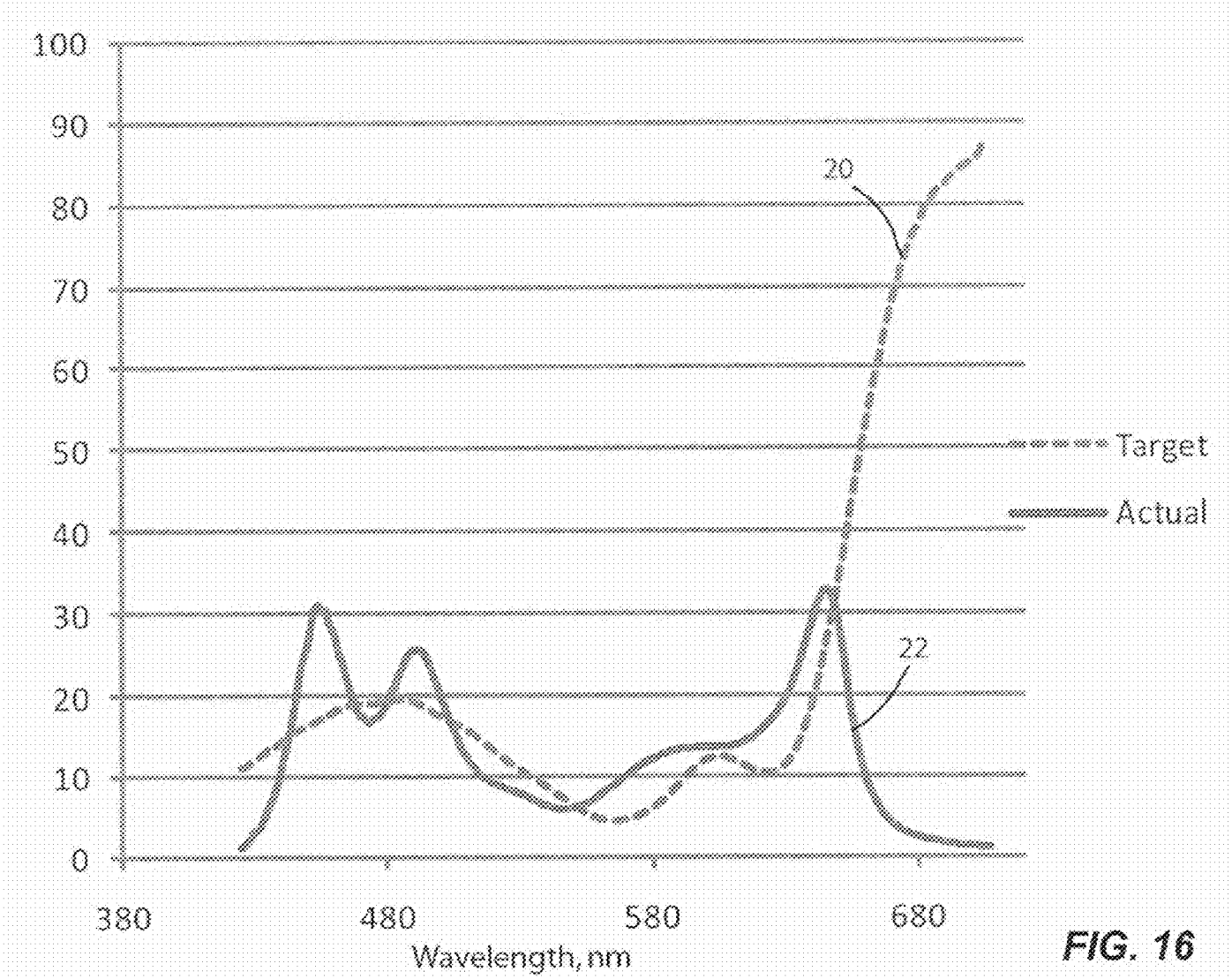
FIG. 16 is a graph of a target spectrum compared to a first composite spectrum from a 7-Color LED array, according to an embodiment of the present invention.
Figure 17:
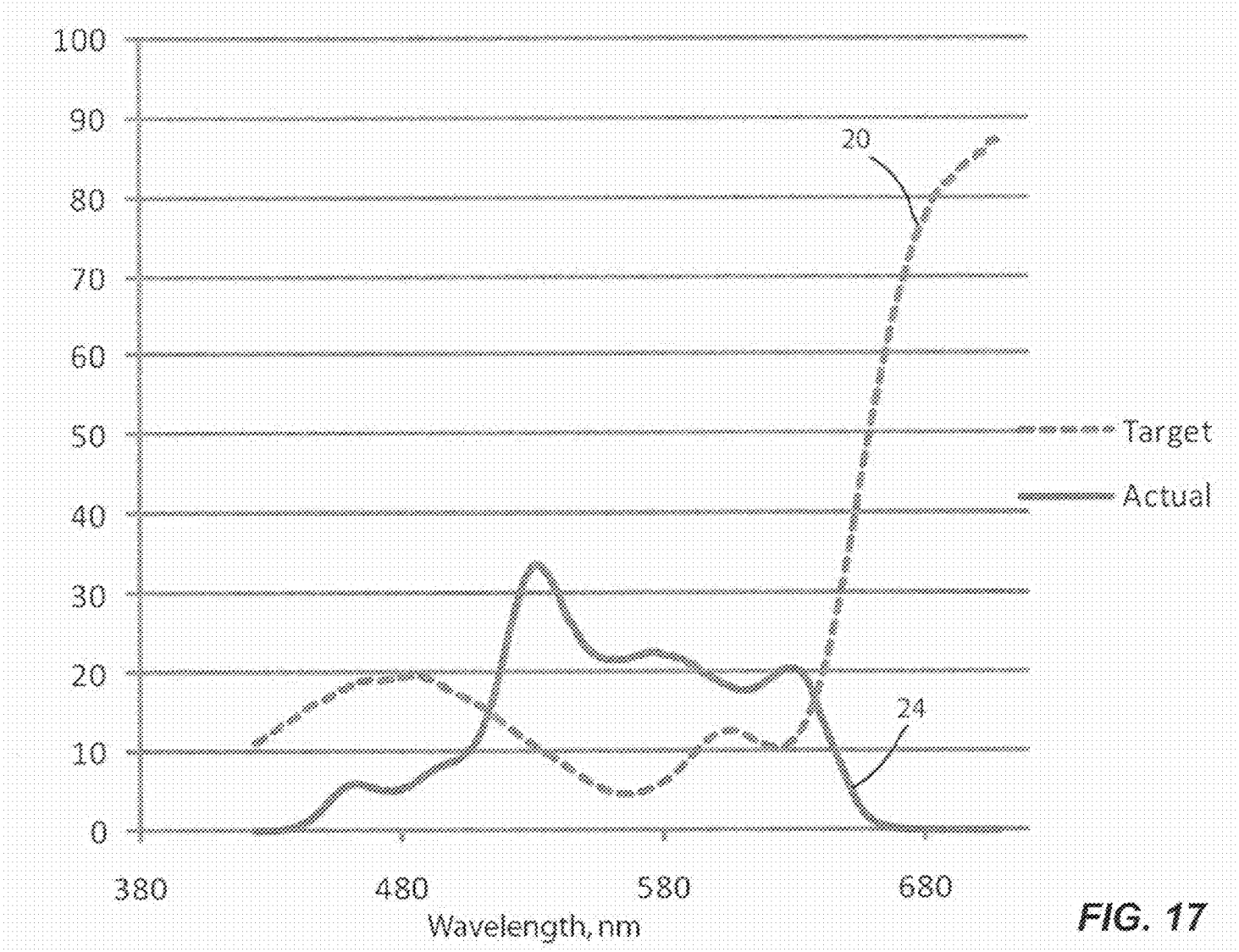
FIG. 17 is a graph of a target spectrum compared to a second composite spectrum from a 7-Color LED array, according to an embodiment of the present invention.

FIGS. 16 and 17 illustrate exemplary results of the methods of the present invention as applied to a seven color LED array having nominal peak wavelengths of approximately 450 nm, 460 nm, 490 nm, 525 nm, 590 nm, 630 nm and 645 nm. FIGS. 16 and 17 illustrate two resultant metamers that both have the same chromaticity coordinates but differing spectra. More particularly, FIG. 16 illustrates a target spectrum 20 and an actual spectrum 22 created from a mix of seven LED wavelengths in an LED array optimized using the process disclosed herein to produce the best spectral match while maintaining a chromaticity match between target spectrum 20 and actual spectrum 22 output by the seven LED array.

FIG. 17 shows the same target spectrum 20 and an alternative actual spectrum 24 created from a mix of seven LED wavelengths in an LED array optimized using the algorithms disclosed herein to produce the highest lumen output while maintaining a chromaticity match between target 20 and alternative actual spectrum 24.

Although the calculations and equations have been illustrated here with a seven color LED array (FIGS. 14 and 16-17) the invention is not so limited and any number of LED wavelengths greater than three may be utilized. With three LED wavelengths as previously stated, the equations disclosed herein collapse to a single unique solution for a chromaticity match such that the single metamer available provides both the best spectral match and the highest lumen match. For numbers of LED wavelengths greater than three the number of metamers increases and the solutions may or may not be the same.

Figure 19:
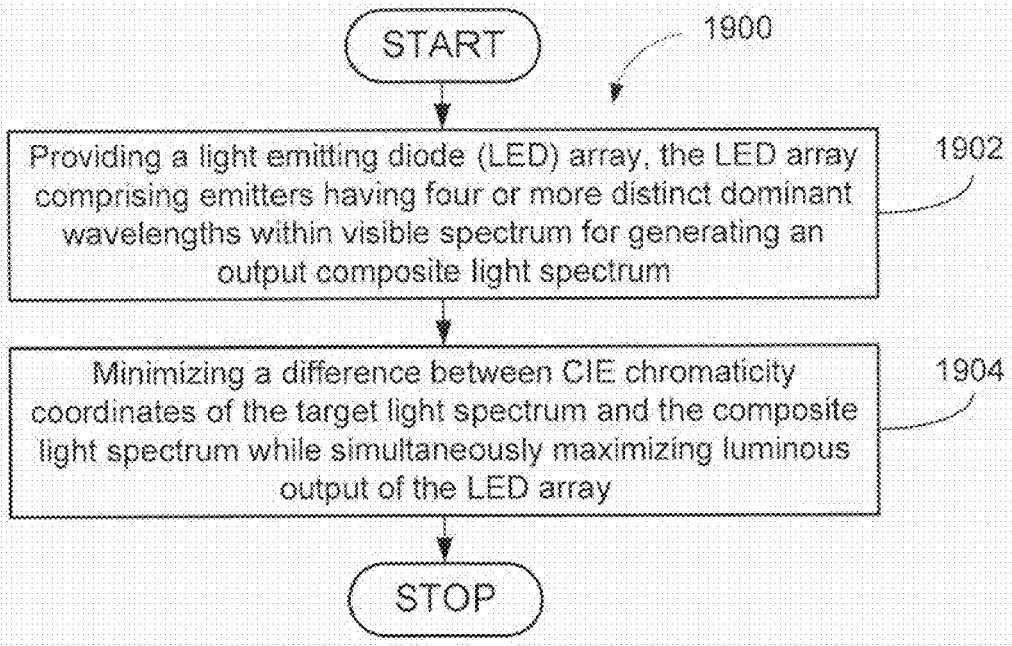
FIG. 19 is a flow chart of an embodiment of a method of matching a composite light spectrum to a target light spectrum, according to the present invention.

FIG. 19 is a flow chart of an embodiment of a method 1900 of matching a composite light spectrum to a target light spectrum, according to the present invention. The method may include providing 1902 a light emitting diode (LED) array, the LED array comprising emitters having four or more distinct dominant wavelengths within visible spectrum for generating an output composite light spectrum. The method may further include minimizing 1904 a difference between CIE chromaticity coordinates of the target light spectrum and the composite light spectrum while simultaneously maximizing luminous output of the LED array. According to another embodiment of the method, minimizing a difference between CIE chromaticity coordinates of the target light spectrum and the composite light spectrum may include the following process steps: (1) calculating the CIE chromaticity coordinates of the target spectrum, $x_t,y_t$, using at least one of: source color temperature, color standard and subject to be illuminated, (2) calculating the CIE chromaticity coordinates of the output composite light spectrum, $x_o,y_o$, (3) calculating a chromaticity error, $E_c$, between the CIE chromaticity coordinates of the target spectrum, $x_t$,$y_t$, and the chromaticity coordinates of the output composite light spectrum, $x_o$,$y_o$, and (4) adjusting mix coefficients of the emitters and recalculating steps (2) and (3) to minimize the chromaticity error, $E_c$.

According to one embodiment, minimizing the chromaticity error, $E_c$, may include applying a least squares optimization process as disclosed herein. According to one embodiment, maximizing luminous output of the LED array may include calculating a total luminous output by integrating an output composite light spectrum function multiplied by a CIE photopic luminous efficacy function over all visible wavelengths, see for example Eq. (2). According to various other embodiments, minimizing a difference between CIE chromaticity coordinates of the target light spectrum and the composite light spectrum may include applying an optimization process, for example and not by way of limitation, one of the following optimization processes: least squares, linear, quadratic, conic, smooth non-linear and non-smooth.

Figure 20:
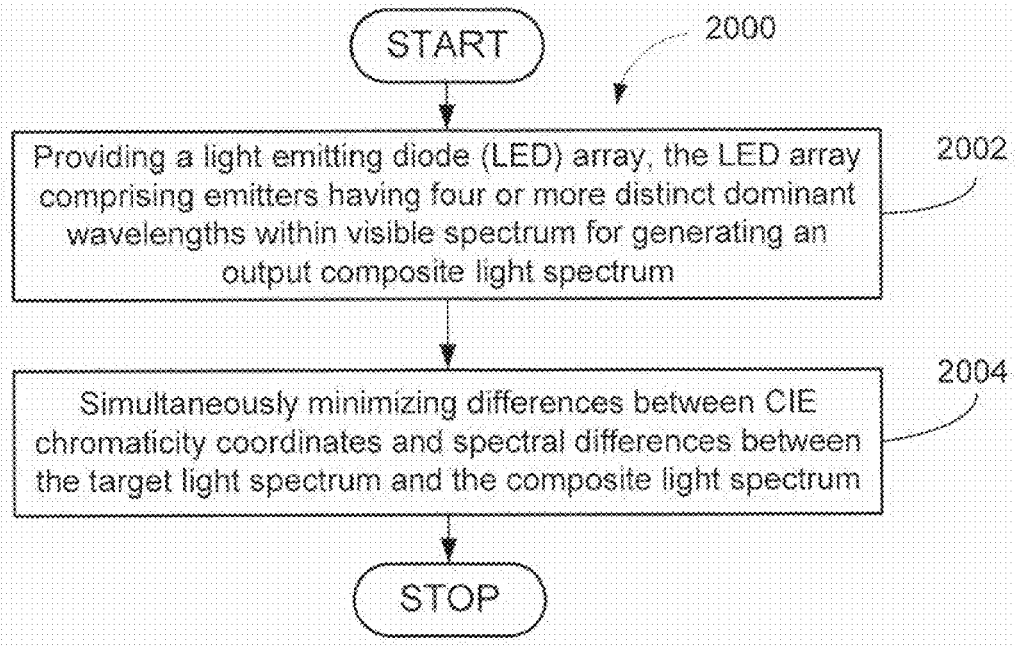
FIG. 20 is a flow chart of an embodiment of a method of matching a composite light spectrum to a target light spectrum, according to the present invention.

FIG. 20 is a flow chart of an embodiment of a method 2000 of matching a composite light spectrum to a target light spectrum, according to the present invention. The method may include providing 2002 a LED array, the LED array comprising emitters having four or more distinct dominant wavelengths within visible spectrum for generating an output composite light spectrum. The method may further include simultaneously minimizing 2004 differences between CIE chromaticity coordinates and spectral differences between the target light spectrum and the composite light spectrum. According to one embodiment, minimizing the differences between CIE chromaticity coordinates of the target light spectrum and the composite light spectrum may include: (1) calculating the CIE chromaticity coordinates of the target spectrum, $x_t$,$y_t$, using at least one of: source color temperature, color standard and subject to be illuminated, (2) calculating the CIE chromaticity coordinates of the output composite light spectrum, $x_o$,$y_o$, (3) calculating a chromaticity error, $E_c$, between the CIE chromaticity coordinates of the target spectrum, $x_t$,$y_t$, and the chromaticity coordinates of the output composite light spectrum, $x_o$,$y_o$ and (4) adjusting mix coefficients of the emitters and recalculating steps (2) and (3) to minimize the chromaticity error, $E_c$. According to another embodiment, minimizing the differences between CIE chromaticity coordinates of the target light spectrum and the composite light spectrum, may include minimizing a chromaticity error defined by Eq. (4) as defined above. According to another embodiment, minimizing the spectral differences between the target light spectrum and the composite light spectrum may include minimizing Eq. (5) as discussed above.

An embodiment of a LED array including four or more distinct dominant wavelengths within visible spectrum configured for generating an output composite light spectrum matched to a preselected target light spectrum is disclosed. The output composite light spectrum of the embodiment provides maximum lumen output. According to one embodiment of the LED array, providing maximum lumen output comprises maximizing Eq. (2) as disclosed above. According to another embodiment of the LED array, the preselected target light spectrum is a color standard. According to various embodiments of an LED array, the color standard may be for example and not by way of limitation, a theatrical gel color, a Pantone™ color, sunlight, or an incandescent lamp with or without color filters. According to one embodiment of the LED array, generating an output composite light spectrum matched to a preselected target light spectrum may include minimizing a chromaticity error between the target light spectrum and the output composite light spectrum.

An embodiment of a light LED array including four or more distinct dominant wavelengths within visible spectrum configured for generating an output composite light spectrum matched to a preselected target light spectrum is disclosed. According to this embodiment, the output composite light spectrum further provides best spectral match between the target light spectrum and the composite light spectrum. According to another embodiment of the LED array, generating an output composite light spectrum matched to a preselected target light spectrum may include minimizing a chromaticity error between the target light spectrum and the output composite light spectrum. According to a particular embodiment of the LED array, the chromaticity error may be defined as in Eq. (4) as disclosed herein. According to yet another embodiment of the LED array, providing a best spectral match between the target light spectrum and the composite light spectrum may include minimizing a spectral error between the target light spectrum and the output composite light spectrum. According to another particular embodiment of the LED array, the spectral error to be minimized is defined in Eq. (5) above.

Figure 18:
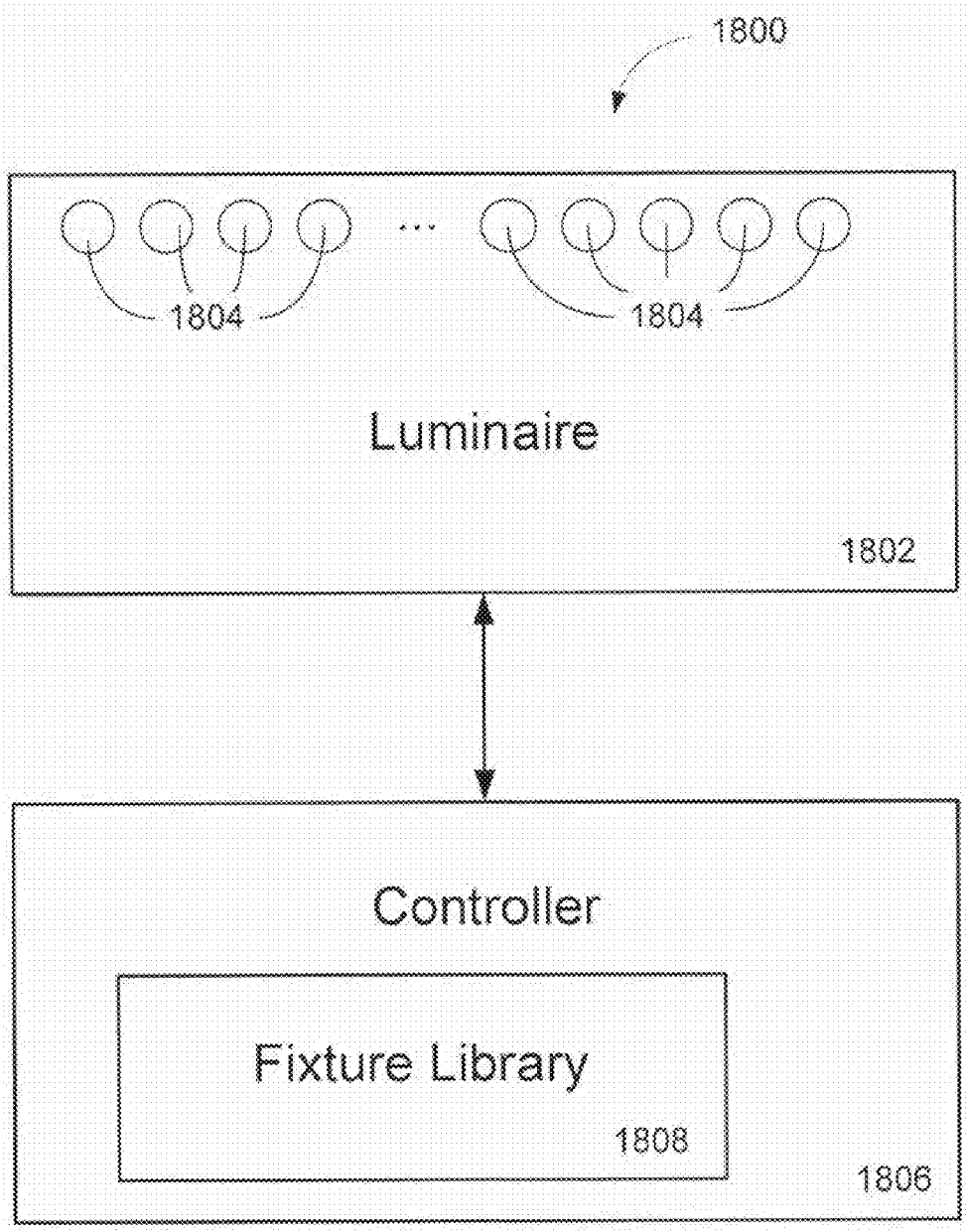
FIG. 18 illustrates a block diagram of an embodiment of a lighting system configured for generating an output composite light spectrum matched to a preselected target light spectrum, according to the present invention.

FIG. 18 illustrates a block diagram of an embodiment of a lighting system 1800 configured for generating an output composite light spectrum matched to a preselected target light spectrum, according to the present invention. System 1800 may include a luminaire 1802 having LEDs 1804 of at least four distinct primary color wavelengths. System 1800 may further include a controller 1806 for driving the luminaire 1802 to generate a composite light spectrum. Controller 1806 may be a theatrical control desk, for example and not by way of limitation, a ETC Eon™, available from the assignee of the present application, Electronic Theater Controls, Inc., 3031 Pleasant View Rd, Middleton, Wis. 53562-0979. The composite light spectrum provides maximum lumen output and is also matched for chromaticity with the preselected target light spectrum, according to one embodiment. According to another embodiment of system 1800, the controller 1806 simultaneously drives the luminaire 1802 to spectrally match the composite light spectrum to the preselected target light spectrum. According to yet another embodiment of system 1800, the controller 1806 may further include a fixture library 1808 having look-up tables for generating control signals driving the luminaire according to selected color standards.

It will be understood that the terms "spectral match" or "spectrally matching" refer to the application of an optimization procedure for spectrally matching the output composite light spectrum of composite light source to a given target spectrum. It will be understood that the spectral match provided by the composite light source will not necessarily be identical to the target spectrum. But, it will be optimally close or as close as possible according to given system constraints. Similarly, the terms "chromaticity match" or "chromaticity matching" refer to the application of an optimization procedure for matching CIE chromaticity coordinates of the output composite light source spectrum to CIE chromaticity coordinates of a given target spectrum. It will be understood that the chromaticity match provided by the composite light source will not necessarily be identical to the target spectrum. But, it will be optimally close or as close as possible according to given system constraints.

Various optimal solution methods consistent with embodiments of the present invention include the "maximal lumens", or "best spectral match to target" optimizations as discussed herein. It will also be understood that other possible optimizations may be formulated according to the teachings of the present invention, e.g., and not by way of limitation: "best color rendering match to target", "color match using the least number of LED colors possible", "color match using the greatest number of LED colors possible," and so on. In general, any match that can be defined and expressed as a numerical error between the target and the actual may be optimized by the teachings of the present invention.

While the foregoing advantages of the present invention are manifested in the illustrated embodiments of the invention, a variety of changes can be made to the configuration, design and construction of the invention to achieve those advantages. For example, while LEDs are the exemplary colored light source described herein, other sources of colored light may be used, e.g., lasers or a LED covered with a narrowband-emitting phosphor or other down-converting medium that is capable of high brightness in dominant wavelengths. Furthermore, other light source technologies, e.g., electroluminescence, electrophoretic display, electrochromic display, electrowetting, gas plasma and fiber plasma, may also be suitable as equivalents for the LEDs described herein to the extent such other light source technologies have the brightness and spectral distribution characteristics described and claimed herein. Hence, reference herein to specific details of the structure and function of the present invention is by way of example only and not by way of limitation.

What is claimed is:

1. A method of matching an output composite light spectrum to a target light spectrum, the method comprising:

providing a light emitting diode (LED) array, the LED array comprising emitters having four or more distinct dominant wavelengths within visible spectrum for generating the output composite light spectrum; and simultaneously minimizing differences between CIE chromaticity coordinates and spectral differences between the target light spectrum and the output composite light spectrum, wherein minimizing the differences between CIE chromaticity coordinates of the target light spectrum and the output composite light spectrum comprises minimizing a chromaticity error, $E_c$, defined by:

$$E_c = W((x_o - x_t)^2 + (y_o - y_t)^2),$$

where $x_t, y_t$, are CIE chromaticity coordinates of the target light spectrum, $x_o, y_o$ are CIE chromaticity coordinates of the output composite light spectrum, and W is a weighting factor.

2. The method according to claim 1, wherein minimizing the differences between CIE chromaticity coordinates of the target light spectrum and the composite light spectrum, comprises:

(1) calculating the CIE chromaticity coordinates of the target light spectrum, $x_t, y_t$, using at least one of: source color temperature, color standard and subject to be illuminated;

(2) calculating the CIE chromaticity coordinates of the output composite light spectrum, $x_o, y_o$;

(3) calculating a chromaticity error, $E_c$, between the CIE chromaticity coordinates of the target light spectrum, $x_t, y_t$, and the chromaticity coordinates of the output composite light spectrum, $x_o, y_o$; and (4) adjusting mix coefficients of the emitters and recalculating steps (2) and (3) to minimize the chromaticity error, $E_c$.

3. The method according to claim 1, wherein minimizing the spectral differences between the target light spectrum and the output composite light spectrum, comprises minimizing a spectral error, $E_s$, defined as:

$$E_s = \sum_{i=1}^{n} [(P(\lambda_i) - F(\lambda_i))^2] \times \bar{y}(\lambda_i),$$

is where $P(\lambda)$ is the target light spectrum, $F(\lambda)$ is the output composite light spectrum, and $\bar{y}(\lambda_i)$ is a CIE photopic function, calculated over n points across the visible spectrum.

4. A light emitting diode (LED) array including four or more distinct dominant wavelengths within visible spectrum configured for generating an output composite light spectrum matched to a preselected target light spectrum wherein the output composite light spectrum provides a spectral match between the target light spectrum and the output composite light spectrum having a chromaticity error, wherein generating the output composite light spectrum matched to a preselected target light spectrum comprises minimizing the chromaticity error between the target light spectrum and the output composite light spectrum, and wherein the chromaticity error, $E_c$, is defined as:

$$E_c = W((x_o - x_t)^2 + (y_o - y_t)^2),$$

where $x_t, y_t$, are CIE chromaticity coordinates of the target light spectrum, $x_o, y_o$ are CIE chromaticity coordinates of the output composite light spectrum, and W is a weighting factor.

5. The LED array according to claim 4, wherein providing best spectral match between the target light spectrum and the output composite light spectrum comprises minimizing a spectral error between the target light spectrum and the output composite light spectrum.

6. The LED array according to claim 5, wherein the spectral error is defined as:

$$E_s = \sum_{i=1}^{n} [(P(\lambda_i) - F(\lambda_i))^2] \times \bar{y}(\lambda_i),$$

where $P(\lambda)$ is the target light spectrum, $F(\lambda)$ is the output composite light spectrum, and $\bar{y}(\lambda_i)$ is a CIE photopic function, calculated over n points across the visible spectrum.

7. A light emitting diode (LED) array including four or more distinct dominant wavelengths within visible spectrum configured for generating an output composite light spectrum matched to a preselected target light spectrum wherein the output composite light spectrum provides a spectral match between the target light spectrum and the composite light spectrum having a spectral error, wherein the spectral error, $E_s$, is defined as:

$$E_s = \sum_{i=1}^{n} [(P(\lambda_i) - F(\lambda_i))^2] \times \bar{y}(\lambda_i),$$

where $P(\lambda)$ is the target light spectrum, $F(\lambda)$ is the output composite light spectrum, and $\bar{y}(\lambda_i)$ is a CIE photopic function, calculated over n points across the visible spectrum.

8. The LED array according to claim 7, wherein generating the output composite light spectrum matched to the preselected target light spectrum comprises minimizing a chromaticity error between the target light spectrum and the output composite light spectrum.

9. The LED array according to claim 8, wherein the chromaticity error, $E_c$, is defined as:

$$E_c = W((x_o - x_t)^2 + (y_o - y_t)^2),$$

where $x_t, y_t$, are CIE chromaticity coordinates of the target light spectrum, $x_o, y_o$ are CIE chromaticity coordinates of the output composite light spectrum, and W is a weighting factor.

10. The LED array according to claim 7, wherein providing the spectral match between the target light spectrum and the output composite light spectrum comprises minimizing the spectral error between the target light spectrum and the output composite light spectrum.

* * * * *